US011237503B2

(12) United States Patent
Furuichi et al.

(10) Patent No.: US 11,237,503 B2
(45) Date of Patent: Feb. 1, 2022

(54) HEATER CONFIGURED TO MAINTAIN ADEQUATE CONTACT PRESSURE WITH A CONTACT TERMINAL, HEATING DEVICE, FIXING DEVICE, AND IMAGE FORMING APPARATUS

(71) Applicants: Yuusuke Furuichi, Kanagawa (JP); Tomoya Adachi, Kanagawa (JP); Yukimichi Someya, Saitama (JP)

(72) Inventors: Yuusuke Furuichi, Kanagawa (JP); Tomoya Adachi, Kanagawa (JP); Yukimichi Someya, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/502,473

(22) Filed: Jul. 3, 2019

(65) Prior Publication Data

US 2020/0033768 A1 Jan. 30, 2020

(30) Foreign Application Priority Data

Jul. 25, 2018 (JP) ..... JP2018-139243
Apr. 9, 2019 (JP) ..... JP2019-074177

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/80* (2013.01);
(Continued)

(58) Field of Classification Search
USPC ..... 219/216; 399/329
See application file for complete search history.

(56) References Cited

U.S. PATENT DOCUMENTS

2011/0076070 A1* 3/2011 Koshida ..... G03G 15/2039 399/328
2013/0336672 A1* 12/2013 Mizuta ..... G03G 15/2053 399/75

(Continued)

FOREIGN PATENT DOCUMENTS

EP 0585857 A1 3/1994
EP 0672968 A2 9/1995

(Continued)

OTHER PUBLICATIONS

U.S. Appl. No. 16/352,390, filed Mar. 13, 2019, Tomoya Adachi, et al.

(Continued)

*Primary Examiner* — Quana Grainger
(74) *Attorney, Agent, or Firm* — Harness, Dickey & Pierce, P.L.C.

(57) ABSTRACT

A heater includes an electrode, a heat generator, and a plurality of layers including a first layer and at least one additional layer disposed in an opposite side with respect to a surface on which the electrode is disposed. The at least one additional layer includes at least one of a plurality of portions, a gap at a location corresponding to the electrode, existing between the plurality of portions and a single portion, at least a part of the single portion corresponding to the electrode, being relatively thinner than a part of the single portion corresponding to the heat generator.

28 Claims, 13 Drawing Sheets

(52) U.S. Cl.
CPC ..... *G03G 2215/2019* (2013.01); *G03G 2215/2035* (2013.01)

(56) References Cited

U.S. PATENT DOCUMENTS

| | | | |
|---|---|---|---|
| 2019/0179242 | A1 | 6/2019 | Adachi et al. |
| 2019/0196374 | A1 | 6/2019 | Adachi et al. |

FOREIGN PATENT DOCUMENTS

| | | | |
|---|---|---|---|
| EP | 1166186 | A1 | 1/2002 |
| EP | 3260928 | A1 | 12/2017 |
| JP | 9-044011 | | 2/1997 |
| JP | 2002-246150 | | 8/2002 |
| JP | 2014-109754 | | 6/2014 |
| WO | WO-2000/55694 | A1 | 9/2000 |

OTHER PUBLICATIONS

U.S. Appl. No. 16/285,733, filed Feb. 26, 2019, Yuusuke Furuichi, et al.
U.S. Appl. No. 16/263,634, filed Jan. 31, 2019, Yuusuke Furuichi, et al.
U.S. Appl. No. 16/269,616, filed Feb. 7, 2019, Tomoya Adachi, et al.
U.S. Appl. No. 16/276,807, filed Feb. 15, 2019, Yukimichi Someya, et al.
Extended European Search Report dated Dec. 2, 2019 in European Application No. 19182372.3.

* cited by examiner

HEATER CONFIGURED TO MAINTAIN ADEQUATE CONTACT PRESSURE WITH A CONTACT TERMINAL, HEATING DEVICE, FIXING DEVICE, AND IMAGE FORMING APPARATUS

CROSS-REFERENCE TO RELATED APPLICATIONS

This patent application is based on and claims priority pursuant to 35 U.S.C. § 119 to Japanese Patent Applications No. 2018-439243, filed on Jul. 25, 2018 and No. 2019-074177, filed on Apr. 9, 2019 in the Japanese Patent Office, the entire disclosures of which are hereby incorporated by reference herein.

BACKGROUND

Technical Field

Embodiments of the present disclosure generally relate to a heater, a heating device, a fixing device and an image forming apparatus.

Background Art

A laminated heater having a planar resistive heat generator is known as a heater used for a drying device to dry ink on a sheet or a fixing device to fix toner on the sheet by heat in an image forming apparatus such as a printer and a copier.

The laminated heater generates heat when power is supplied to the resistive heat generator. Therefore, the laminated heater includes an electrode to which a connector is electrically connected to supply power from the power supply.

SUMMARY

This specification describes an improved heater that includes an electrode, a heat generator, and a plurality of layers including a first layer and at least one additional layer disposed in an opposite side with respect to a surface on which the electrode is disposed. The at least one additional layer includes at least one of a plurality of portions, a gap at a location corresponding to the electrode, existing between the plurality of portions and a single portion, at least a part of the single portion corresponding to the electrode, being relatively thinner than a part of the single portion corresponding to the heat generator.

This specification further describes an improved heater to contact a contact portion that in turn contacts at least one of a holder and a connector that includes an electrode, a heat generator, and a plurality of layers including a first layer and at least one layer disposed in an opposite side with respect to a surface on which the electrode is disposed. The at least one layer includes at least one of a plurality of portions, a gap, at a position at which the contact portion contacts the heater, existing between the plurality of portions, and a single portion, a thickness of at least a part of the single portion of the at least one layer, at a position at which the contact portion contacts the heater, being relatively thinner than a thickness of at least a part of the single portion of the at least one layer, at a position at which the contact portion does not contact the heater.

This specification still further describes an improved heater that includes an electrode, a heat generator, and a plate including a portion corresponding to the electrode. The portion of the plate corresponding to the electrode is relatively thinner than a portion of the plate corresponding to the heat generator.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
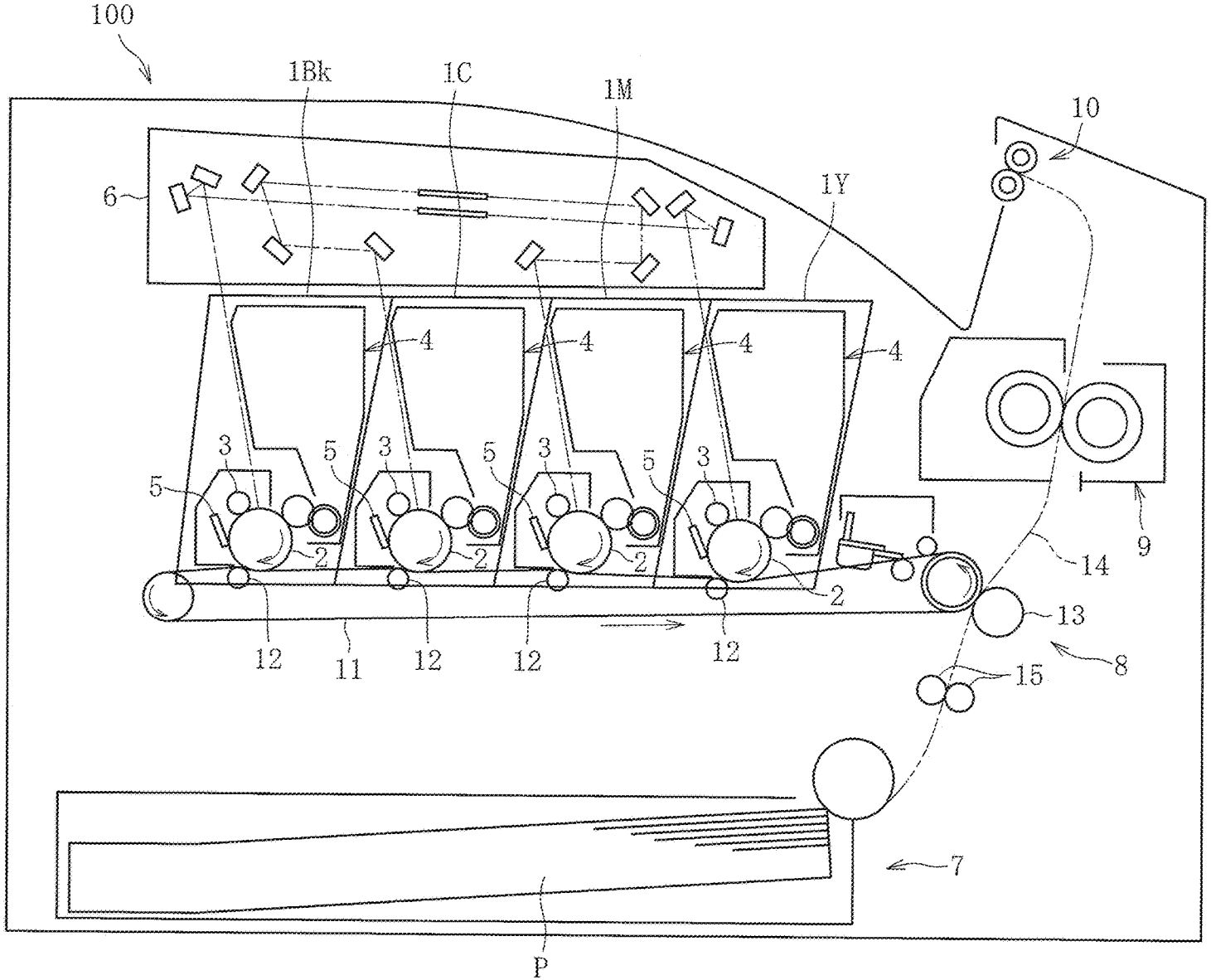
FIG. 1 is a schematic diagram of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

FIG. 1 is a schematic diagram illustrating a configuration of an image forming apparatus according to an embodiment of the present disclosure.

The image forming apparatus 100 illustrated in FIG. 1 includes four image forming units 1Y, 1M, 1C, and 1Bk detachably attached to an apparatus body thereof. The image forming units 1Y, 1M, 1C, and 1Bk have the same configuration except for containing different color developers, i.e., yellow (Y), magenta (M), cyan (C), and black (Bk) toners, respectively, corresponding to decomposed color separation components of full-color images. Specifically, each of the image forming units 1Y, 1M, 1C, and 1Bk includes: a photoconductor 2 in a drum-like shape as an image bearer; a charger 3 to charge a surface of the photoconductor 2; a developing device 4 configured to form a toner image by supplying toner, as a developer, to a surface of the photoconductor 2; and a cleaner 5 to clean the surface of the photoconductor 2.

The image forming apparatus 100 further includes an exposure device 6 to expose the surface of each photoconductor 2 to form an electrostatic latent image, a sheet feeder 7 to supply a sheet P as a recording medium, a transfer device 8 to transfer the toner image formed on the each photoconductor 2 onto the sheet P, a fixing device 9 to fix the transferred toner image onto the sheet P, and an output device 10 to eject the sheet P outside the image forming apparatus 100.

The transfer device 8 includes: an intermediate transfer belt 11 in the form of an endless belt stretched taut with multiple rollers, as an intermediate transferor; four primary transfer rollers 12 each as a primary transferor to transfer the toner image formed on each photoconductor 2 onto the intermediate transfer belt 11; and a secondary transfer roller 13 as a secondary transferor to transfer the toner image transferred onto the intermediate transfer belt 11 onto the sheet P. The primary transfer rollers 12 are in contact with the respective photoconductors 2 via the intermediate transfer belt 11. Therefore, the intermediate transfer belt 11 is in contact with the respective photoconductors 2, thus forming primary transfer nips therebetween. The secondary transfer roller 13 contacts, via the intermediate transfer belt 11, one of the plurality of rollers around which the intermediate transfer belt 11 is stretched. Thus, the secondary transfer nip is formed between the secondary transfer roller 13 and the intermediate transfer belt 11.

In the image forming apparatus 100, a sheet conveyance path 14 is formed through which the sheet P fed from the sheet feeder 7 is conveyed. A timing roller pair 15 is disposed on the sheet conveyance path 14 on the way from the sheet feeder 7 to the secondary transfer nip (the secondary transfer roller 13).

Next, a description is given of a print operation of the image forming apparatus 100 with reference to FIG. 1.

As a print operation start is instructed, in each of the image forming units 1Y, 1M, 1C, and 1Bk, the photoconductors 2 are each driven to rotate clockwise in FIG. 1 and the surfaces thereof are uniformly charged to a high potential by the respective chargers 3. Subsequently, according to either image data of a document scanned by a scanner or print data instructed from a terminal, the exposure device 6 exposes the surface of the photoconductor 2. Thus, the potential of the exposed portion decreases, and an electrostatic latent image is formed. The developing device 4 supplies toner to the electrostatic latent image, thereby developing the latent image into the toner image on each of the photoconductors 2.

The toner image on each of the photoconductors 2 reaches the primary transfer nip at each of the primary transfer rollers 12 in accordance with rotation of each of the photoconductors 2 and is sequentially transferred and superimposed onto the intermediate transfer belt 11 that is driven to rotate counterclockwise in FIG. 1. In accordance with rotation of the intermediate transfer belt 11, the toner image transferred onto the intermediate transfer belt 11 reaches the secondary transfer nip at the secondary transfer roller 13 and is transferred onto the conveyed sheet P at the secondary transfer nip. The sheet P is fed from the sheet feeder 7. The timing roller pair 15 temporarily stops the sheet P fed from the sheet feeder 7 and conveys the sheet P to the secondary transfer nip, timed to coincide with the toner image on the intermediate transfer belt 11. Thus, a full-color toner image is formed on the sheet P. After the toner image is transferred from each of the photoconductors 2 onto the intermediate transfer belt 11, each of cleaners 5 removes residual toner on each of the photoconductors 2.

The sheet P transferred the toner image is conveyed to the fixing device 9 that fixes the toner image on the sheet P. Subsequently, the output device 10 ejects the sheet P outside the image forming apparatus 100, and a series of print operations are completed.

Next, a configuration of the fixing device 9 is described.

Figure 2:
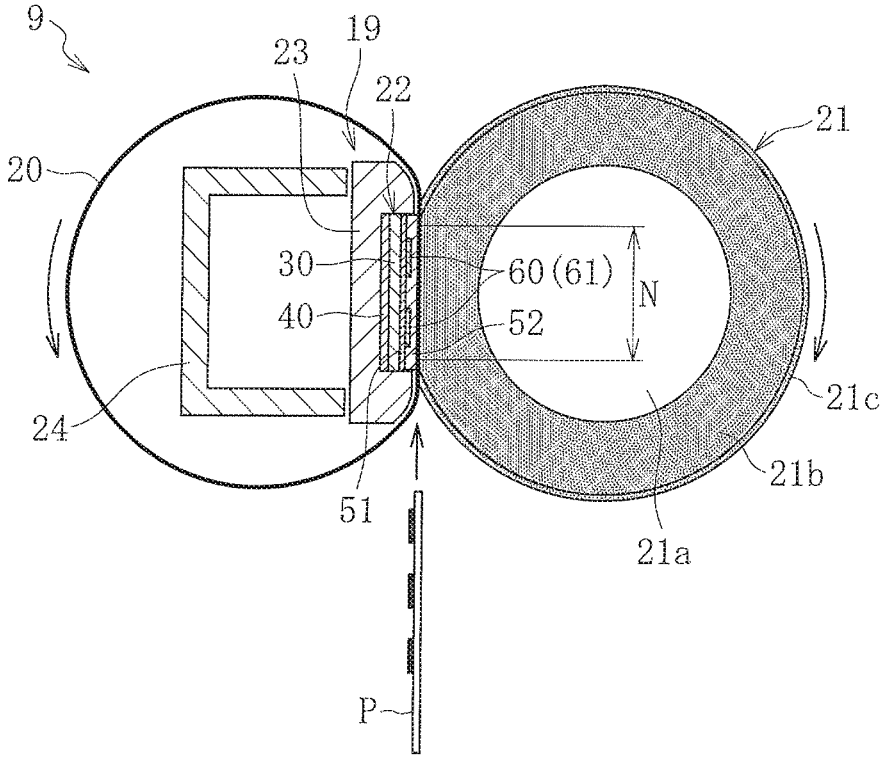
FIG. 2 is a schematic diagram of a fixing device.

As illustrated in FIG. 2, the fixing device 9 according to the present embodiment includes an endless fixing belt 20 as a fixing rotator, a pressure roller 21 as an opposed rotator to contact an outer circumferential surface of the fixing belt 20 and form a nip N, and a heating device 19 to heat the fixing belt 20. The heating device 19 includes a laminated heater 22 as a heater, a heater holder 23 as a holder to hold the heater 22, and a stay 24 as a supporter to support the heater holder 23.

The fixing belt 20 includes, for example, a tubular base made of polyimide (PI), the tubular base having an outer diameter of 25 mm and a thickness of from 40 to 120 μm. On the outermost layer of the fixing belt 20, a release layer made of a fluorine-based resin, such as a perfluoroalkoxy alkane (PFA) or polytetrafluoroethylene (PTFE), having a thickness of from 5 to 50 μm, is formed in order to improve durability and ensure releasability. An elastic layer made of rubber having a thickness of from 50 to 500 μm may be provided between the base and the release layer. The base of the fixing belt 20 is not limited to polyimide, and thus may be made of heat-resistant resin, such as polyetheretherketone (PEEK), or a metal, such as nickel (Ni) or stainless steel (SUS). The inner circumferential surface of the fixing belt 20 may be coated with polyimide or polytetrafluoroethylene (PTFE) as a slide layer.

The pressure roller 21 having, for example, an outer diameter of 25 mm, includes a bar 21*a* made of solid iron, an elastic layer 21*b* on the surface of the bar 21*a*, and a release layer 21*c* formed on the outside of the elastic layer 21*b*. The elastic layer 21*b* is made of silicone rubber and has, for example, a thickness of 3.5 mm. Preferably, the release layer 21*c* is formed by a fluororesin layer having, for example, a thickness of approximately 40 μm on the surface of the elastic layer 21*b* to improve releasability.

The heater 22 extends in a longitudinal direction thereof parallel to a width direction of the fixing belt 20. The heater 22 includes a heat insulation layer 40, a base layer 30, a first insulation layer 51, a conductor layer 60 that includes a heat generator 61, and a second insulation layer 52, all of which are layered, in the order just given, onto and from the heater holder 23 toward the fixing belt 20, that is, the nip N.

The heater holder 23 and the stay 24 are disposed inside the inner circumferential surface of the fixing belt 20. The stay 24 is configured by a channeled metallic member, and both side plates of the fixing device 9 support respective end portions of the stay 24. Supporting the heater holder 23 and the heater 22 held by the heater holder 23 by the stay 24 causes the heater 22 to be subjected to a pressing force of the pressure roller 21 while the pressure roller 21 presses the fixing belt 20 and forms the nip N stably.

The heater holder 23 is preferably made of heat-resistant material because heat from the heater 22 causes the heater holder 23 get hot. The heater holder 23 made of heat-resistant resin having low thermal conduction, such as a liquid crystal polymer (UT), reduces heat transfer from the heater 22 to the heater holder 23 and provides efficient heating of the fixing belt 20.

A biasing member such as a spring presses the pressure roller 21 against the fixing belt 20. As a result, the pressure roller 21 is pressed against the heater 22 via the fixing belt 20 to form the nip N between the fixing belt 20 and the pressure roller 21. A driver drives and rotates the pressure roller 21 in a direction of an arrow illustrated in FIG. 2, and this rotation of the pressure roller 21 rotates the fixing belt 20.

When the print operation starts, the pressure roller 21 is driven to rotate, and the fixing belt 20 starts to be rotated. The heater 22 is supplied with power, heating the fixing belt 20. When the temperature of the fixing belt 20 reaches a predetermined target temperature called a fixing temperature, as illustrated in FIG. 2, the sheet P bearing an unfixed toner image is conveyed to the nip N between the fixing belt 20 and the pressure roller 21, and the unfixed toner image is heated and pressed on to the sheet P and fixed thereon.

Figure 3:
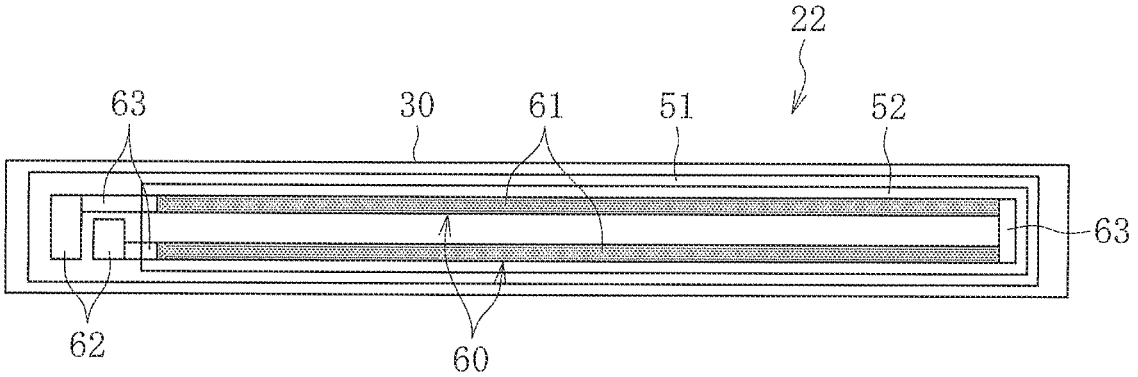
FIG. 3 is a plan view of a heater.
Figure 4:
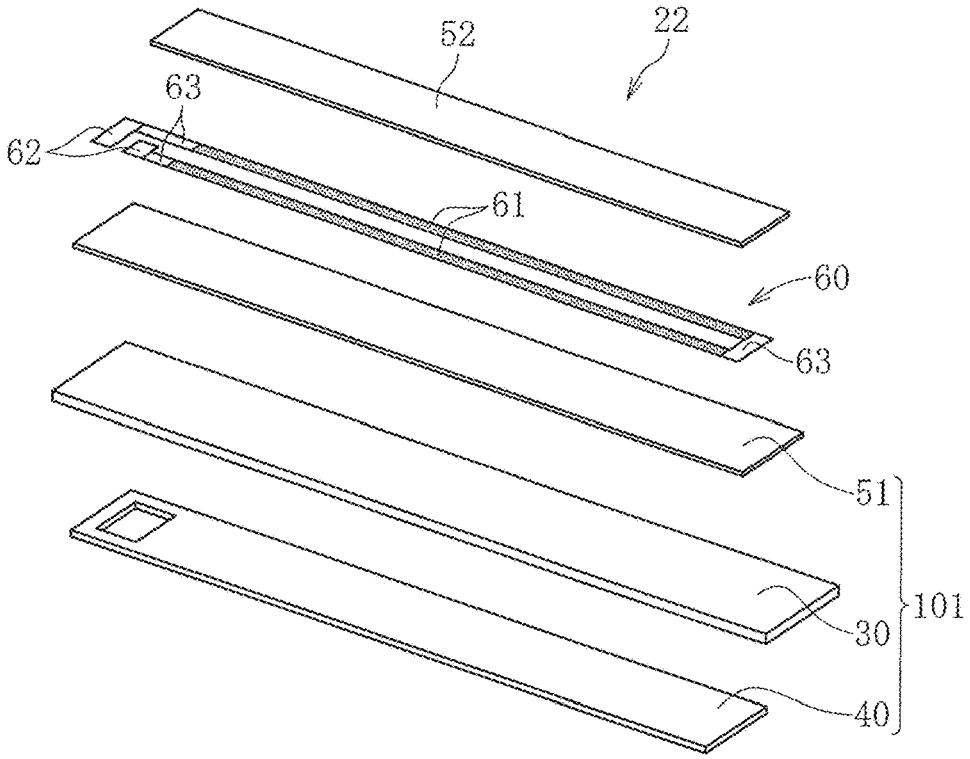
FIG. 4 is an exploded perspective view of the heater.

FIG. 3 is a plan view of the heater 22 as viewed from the front side, and FIG. 4 is an exploded perspective view of the heater 22. In the following description according to the present embodiment, the fixing belt 20 side, that is, the nip N side with respect to the heater 22 is referred to as "front side", and the heater holder 23 side is referred to as "back side".

As illustrated in FIG. 4, the heater 22 according to the present embodiment is the heater including a plurality of layers, electrodes, and the heat generator connected to the electrodes. The plurality of layers included in the heater 22 are integrally formed. A method to form the layers integrally is, for example, a method coating the base layer 30. In the present embodiment, examples of the plurality of layers included in the heater 22 are as follows. The heater 22 according to the present embodiment includes the planar base layer 30, the first insulation layer 51 disposed on the front side of the base layer 30, the conductor layer 60 disposed on the front side of the first insulation layer 51, the second insulation layer 52 that covers the front side of the conductor layer 60, and the heat insulation layer 40 disposed on the back side of the base layer 30 and is configured by stacking the plurality of these layers. The conductor layer 60 includes a pair of heat generators 61 formed of the laminated heaters, a pair of electrodes 62 disposed on one end in the longitudinal direction of each heat generator 61, and a plurality of power supply lines 63 connecting the electrodes 62 and the heat generators 61 to each other. In addition, as illustrated in FIG. 3, at least one part of each electrode 62 in the conductor layer 60 is exposed without being covered by the second insulation layer 52 to ensure connection with a connector described later.

The heat generator 61 may be made, for example, by coating on the base layer 30 with paste in which silver palladium (AgPd) and glass powder are compounded, by screen printing, after that, by baking the base layer 30. The material of the heat generator 61 may include a resistance material, such as silver alloy (AgPt) or ruthenium oxide (RuO2), other than the above material. In the present embodiment, the pair of heat generators 61 extend in the longitudinal direction of the base layer 30 in parallel with each other. Right ends of the heat generators 61 in FIG. 3, that is, ends of heat generators 61 in one side are electrically connected to each other through the power supply line 63, and left ends of the heat generators 61 in FIG. 3, that is, ends of heat generators 61 in the other side are electrically connected to the electrodes 62 through the different power supply line 63. The power supply lines 63 are made of a conductor having a resistance value smaller than that of the heat generators 61. Silver (Ag), silver palladium (AgPd) or the like may be used as a material of the power supply line 63 or the electrode 62, and screen-printing such a material forms the power supply line 63 or the electrode 62.

Although the heat generator 61 is disposed on the front side of the base layer 30 in the present embodiment, alternatively, the heat generator 61 may be disposed on the back side of the base layer 30. In that case, since the heat of the heat generator 61 is transmitted to the fixing belt 20 through the base layer 30, it is preferable that the base layer 30 be made of a material with high thermal conductivity such as aluminum nitride. Making the base layer 30 with a material having a high thermal conductivity enables to sufficiently heat the fixing belt 20 even if the heat generator 61 is disposed on the back side of the base layer 30. Even when the base layer 30 is made of aluminum nitride, coating the materials of the layers other than the base layer 30 enables integrally forming the layers.

The base layer 30 is made of a metal material such as stainless steel (SUS), iron, or aluminum, or, the base layer 30 may be made of ceramic, glass, etc. other than the metal material. The first insulation layer 51, the second insulation layer 52, and the heat insulation layer 40 are made of material having electrical insulation, high thermal conductivity, and heat resistance. In particular, materials having high insulating properties and heat resistance are preferable. Specifically, examples of these materials include heat-resistant resins such as glass, ceramic, and polyimide (PI). Increasing a thickness of each of the first insulation layer 51 and the second insulation layer 52 improves the electrical insulation but decreases thermal conductivity from the heat generator 61 to the fixing belt 20 and increase the cost. Therefore, the thickness of the first insulation layer 51 and the second insulation layer 52 is preferably 10 μm to 300 μm, and more preferably 30 μm to 150 μm. In the present embodiment, in order to increase the thermal conductivity, each of the first insulation layer 51 and the second insulation layer 52 is made of glass with a thickness of 100 μm to which a ceramic filler is added. Since the heat insulation layer 40 is required to have heat resistance and heat insulation, the heat insulation layer 40 is made of glass, ceramics, or heat resistant resin such as polyimide. Increasing a thickness of the heat insulation layer 40 improves heat insulation but increases the cost. Therefore, the thickness of the heat insulation layer 40 is preferably 10 μm to 300 μm, and more preferably 30 μm to 150 μm. In the present embodiment, in order to improve the heat insulation, the heat insulation layer 40 is made of glass with a thickness of 100 μm.

Figure 5:
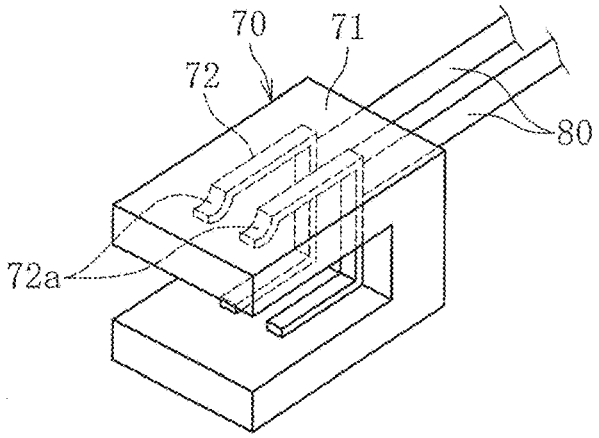
FIG. 5 is a perspective view of a connector.

FIG. 5 is a perspective view illustrating the connector 70 coupled to the heater 22. The heating device 19 according to the present embodiment includes the connector 70 to supply power to the heat generator 61 of the heater 22. As illustrated in FIG. 5, the connector 70 includes a housing 71 made of resin and a contact terminal 72 including a flat spring fixed to the housing 71. The contact terminal 72 has a pair of contact portions 72*a* to contact the respective electrodes 62 of the heater 22. In addition, a power supply harness 80 is coupled to the connector 70.

Figure 6:
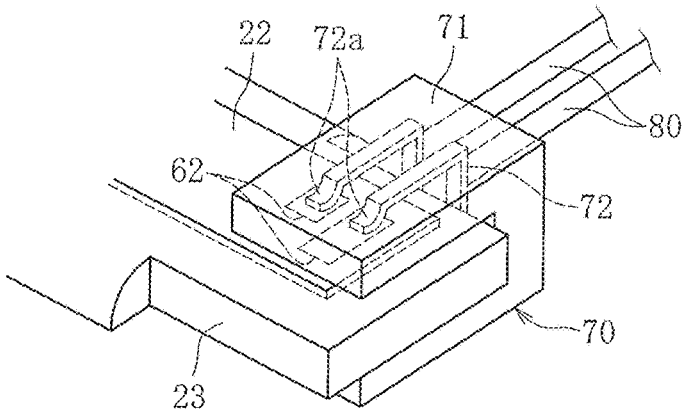
FIG. 6 is a perspective view illustrating the connector connected to the heater.

As illustrated in FIG. 6, the connector 70 is attached so as to sandwich the heater 22 and the heater holder 23 from the front side and the back side together. Thus, the contact portions 72*a* of the contact terminal 72 elastically contact and press against the electrodes 62 of the heater 22, and the heat generator 61 is electrically connected to the power supply provided in the image forming apparatus via the connector 70 and can receive power from the power supply.

In the configuration in which the contact terminal 72 is pressed against the electrode 62 and coupled to the electrode 62, as described in the present embodiment, any variation in the thickness (that is, a length in a lamination direction) of the heater 22 due to the combined tolerances of layers in the heater 22 changes a contact position between the contact terminal 72 and the electrode 62 of the heater 22 in the thickness direction. As a result, the contact pressure at the contact terminal 72 with respect to the electrode 62 also varies. Therefore, since an increase of the variation in a thickness of the heater 22 results in an increase in the contact pressure of the contact terminal 72, the increase of the variation in the thickness of the heater 22 complicates control of the contact pressure to an appropriate value (within an appropriate range). If the contact pressure of the contact terminal 72 falls below the appropriate range, shortage of the contact pressure hinders maintaining electrical continuity, and an adequate electric power supply to the heater 22 is not ensured. In contrast, if the contact pressure of the contact terminal 72 exceeds an appropriate range, the contact terminal 72 and the electrode 62 of the heater 22 will wear when the heater 22 moves minutely due to vibration at the time of driving and power supply to the heater 22 becomes irregular. The heater moves slightly because the heater expands and contracts in the longitudinal direction of the heater due to heat and vibrates when the fixing belt vibrates due to acceleration and deceleration when the gear does not mesh properly with the pressure roller. In addition, the heater and the heater holder move slightly because sliding friction works the heater and the heater holder when the fixing belt slides on the heater and the heater holder.

A detailed description is given of the configuration of the heating device according to the present embodiment as follows. In the configuration according to the present embodiment, the following measures are taken to prevent above-described contact pressure defects (insufficient contact pressure or excessive contact pressure) of the contact terminal 72 caused by the variation in the thickness of the heater 22.

Figure 7:
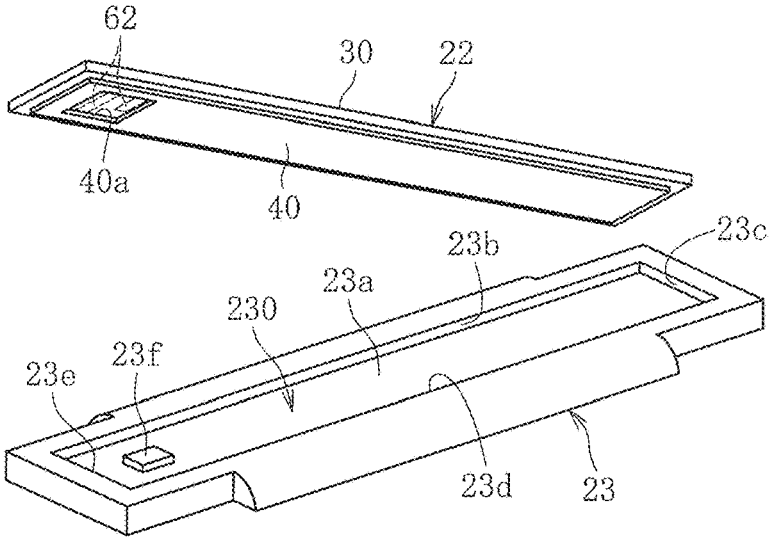
FIG. 7 is a perspective view illustrating the heater and a heater holder according to a first embodiment of the present disclosure.
Figure 8:
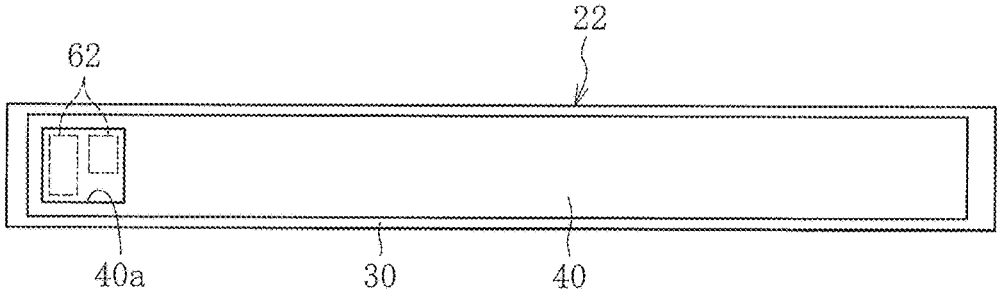
FIG. 8 is a bottom view illustrating the heater viewed from a back side.

FIG. 7 is a perspective view illustrating the heater 22 and the heater holder 23 according to the present embodiment. FIG. 8 is a bottom view illustrating the heater 22 viewed from a back side.

As illustrated in FIGS. 7 and 8, the heater 22 in the present embodiment has a rectangular hole 40*a* formed in the heat insulation layer 40 disposed on the back side of the heater 22, that is, the side opposite to the side on which the conductor layer 60 is disposed. In other words, the heat insulation layer 40 is disposed in the opposite side with respect to a surface on which the electrode is disposed. The hole 40*a* is disposed at a position corresponding to the electrodes 62 disposed on the front side of the base layer 30. That is, the heat insulation layer 40 is disposed on the back side of the base layer except for the back-side portion of the base layer 30 corresponding to the electrodes 62, and a surface on the back-side portion of the base layer 30 corresponding to the electrode 62 is exposed. In other words, the heat insulation layer 40 has a plurality of portions around the hole 40*a*, and has a gap formed by the hole 40*a* between the plurality of portions.

On the other hand, the heater holder 23 includes a protrusion 23*f* in a recessed portion 230 of the heater holder 23 in which the heater 22 is accommodated. The recessed portion 230 has a bottom portion 23*a* formed in a rectangular shape substantially the same size as the heater 22, and four side surface portions 23*b*, 23*c*, 23*d*, and 23*e* provided on each side (four sides) of the bottom portion 23*a*. In the recessed portion 230, the protrusion 23*f* is provided in the position corresponding to the hole 40*a* formed in the heat insulation layer 40 so that the protrusion 23*f* protrudes from the bottom portion 23*a*.

Figure 9:
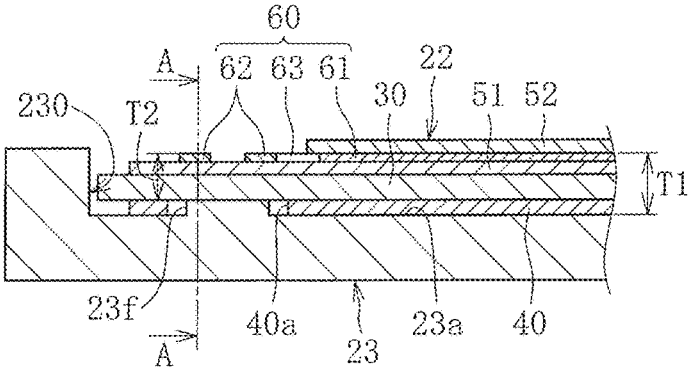
FIG. 9 is a longitudinal cross-sectional view illustrating the heater held by the heater holder.
Figure 10:
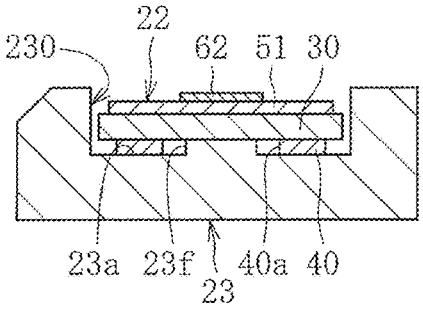
FIG. 10 is a cross-sectional view of the heater held by the heater holder along a line A-A of FIG. 9.

FIG. 9 is a longitudinal cross-sectional view illustrating the heater 22 held by the heater holder 23, and FIG. 10 is a cross-sectional view of the heater held by the heater holder along a line A-A of FIG. 9.

As illustrated in FIGS. 9 and 10, when the heater 22 is accommodated and held in the recessed portion 230 of the heater holder 23, the protrusion 23*f* of the heater holder 23 is inserted into the hole 40*a* of the heat insulation layer 40, and a tip of the protrusion 23*f* is in contact with the back surface of the base layer 30. As described above, the tip of the protrusion 23*f* contacts the back surface of the base layer 30, and the protrusion 23*f* supports the base layer 30. The protrusion 23*f* of the heater holder 23 is a contact portion that contacts the base layer 30, but there is a slight gap between the bottom portion 23*a* of the heater holder 23 and the heat insulation layer 40, and the bottom portion 23*a* is a portion not in contact with the back surface of the heater 22. That is, in the present embodiment, the heat insulation layer 40 is removed and the hole 40*a* is provided in at least one part of the portion on which the contact portion of the heater holder 23, that is, the protrusion 23*f*, contacts the back surface of the heater 22.

Figure 11:
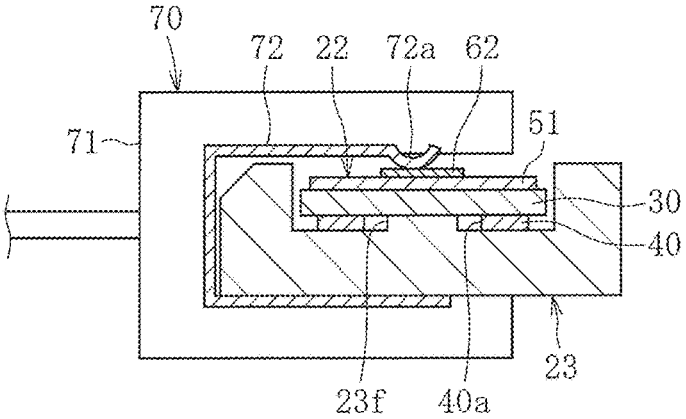
FIG. 11 is a cross-sectional view illustrating the heater held by the heater holder and connected to a connector.

FIG. 11 is a cross-sectional view illustrating the heater 22 held by the heater holder 23 and connected to the connector 70.

As illustrated in FIG. 11, when the connector 70 is attached, the heater 22 and the heater holder 23 are sandwiched from the front side and the back side together and held by the contact terminal 72. In addition, in this state, the pair of contact portions 72*a* of the contact terminal 72 is pressed against the electrodes 62 of the heater 22.

As described above, the variation in the thickness of the heater 22 at the contact portions 72*a* on which the contact terminal 72 is pressed against the electrodes 62 varies the contact pressure of the contact terminal 72 on the electrode 62. Such variation in the thickness of the heater 22 tends to increase as the number of layers in the heater 22 increases. Conversely, decreasing the number of layers in the heater 22 can reduce the variation in the thickness of the heater 22.

Figure 12:
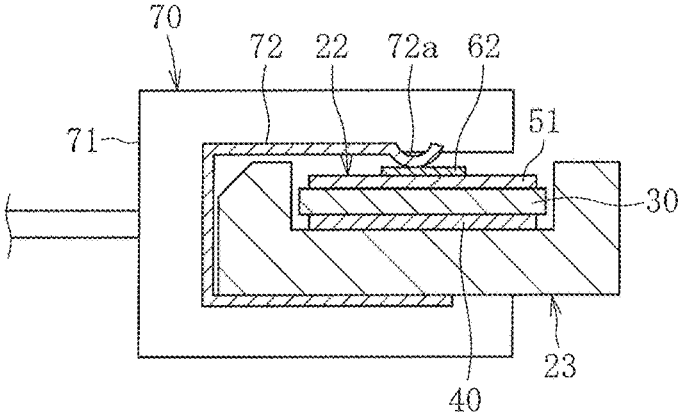
FIG. 12 is a cross-sectional view illustrating a comparative example of the heater including a heat insulation layer disposed on a portion corresponding to an electrode.

Focusing on such a point, as illustrated in FIGS. 8 to 11, the heater 22 in the present embodiment omits the heat insulation layer 40 on the back side of the base layer 30 corresponding to the electrodes 62, and the number of layers in the heater is reduced at the contact points between the electrodes 62 and the contact terminals 72. This can reduce the variation in the thickness of the heater 22 at the contact points between the electrodes 62 and the contact terminals 72 compared with the heater including the heat insulation layer 40 disposed on a portion corresponding to the electrodes 62 as illustrated in FIG. 12 because the number of layers in the heater 22 on the portion corresponding to the electrodes 62 is small, and, therefore, the combined tolerances of the layers in the heater decreases. As a result, since the variation in the contact pressure of the contact terminals 72 is reduced, and since the contact pressure can be easily managed and prevented from being insufficient or excessive, the contact pressure can be set to the appropriate value (that is, within the appropriate range).

As described above, in the present embodiment, since the heat insulation layer 40 is omitted in a portion corresponding to the electrode 62, as illustrated in FIG. 9, a total thickness T2 in the lamination direction from a front side surface of the conductor layer 60 at the portion corresponding to the electrode 62 to a back side surface of the heater 22 that is the back side surface of the base layer 30 in the example illustrated in FIG. 9 is thinner than a total thickness T1 in the lamination direction from a front side surface of the conductor layer 60 at a portion corresponding to the heat generator 61 to the back side surface of the heater 22 that is a back side surface of the heat insulation layer 40 in the example illustrated in FIG. 9 by the thickness of the heat insulation layer 40. In other words, the total thickness in the lamination direction of the portion including the layers in the heater 22 and are layered from the conductor layer 60 toward the base layer 30 is thinner at the portion corresponding the electrode 62 (T1) than at the portion corresponding to the heat generator 61 (T2). General the variation in thickness tends to increase as the thickness of a member increases. Accordingly, as the heat insulation layer 40 becomes thicker, the effect of reducing the variation in heater thickness by partially omitting the heat insulation layer 40 becomes greater. Therefore, the thickness of the heat insulation layer 40 is desirably, for example, 50 μm or more. From the same viewpoint, the thickness of the heat insulation layer 40 is preferably 100 μm or more and more preferably 120 μm or more. In the laminated heater used in the fixing device, since an upper limit of the thickness of the heat insulation layer 40 is generally 175 μm or less, the most preferable range of the thickness of the heat insulation layer 40 is from 120 μm to 175 μm. Further, in the present embodiment, since the thickness of the heat insulation layer 40 corresponds to the difference between the total thickness T1 at the portion corresponding to the heat generator 61 and the total thickness T2 at the portion corresponding to the electrode 62, in other words, the difference between these layer thicknesses becomes more preferable as the difference becomes 50 μm or more, 100 μm or more, and 120 μm or more, and the most preferable range is 120 μm or more and 175 μm or less.

In the present embodiment, since the heat insulation layer 40 is not disposed at the portion corresponding to the electrode 62, the protrusion 23*f* is disposed on the heater holder 23 to support the base layer 30 from the back side at the portion corresponding to the electrode 62. As described above, since the protrusion 23*f* disposed on the heater holder 23 supports the back side of the base layer 30, the bending of the heater 22 decreases, and the contact pressure of the contact terminal 72 with respect to the electrode 62 becomes stable. In addition, decrease of the bending of the heater 22 can prevent damage to the heater 22 due to the bending.

Figure 13:
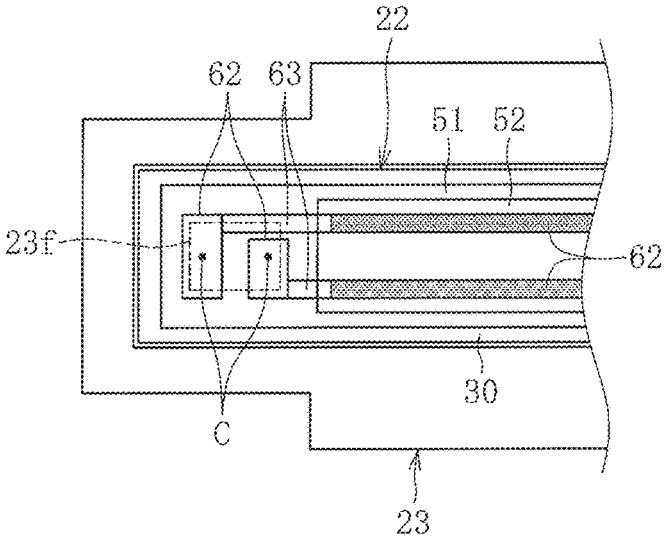
FIG. 13 is a plan view illustrating an arrangement of a protrusion with respect to contact points between contact terminals and electrodes.

Based on the above described function of the protrusion 23*f*, the protrusion 23*f* is preferably disposed at a position on which the contact pressure from the contact terminal 72 to the electrode 62 can be effectively received. Specifically, as illustrated in FIG. 13, the protrusion 23*f* is preferably disposed at a position corresponding to at least the contact position C between the contact terminal 72 and the electrode 62 in a planar view. Disposing the protrusion 23*f* at such a position enables the protrusion 23*f* to effectively receive the contact pressure from the contact terminal 72, stabilizes the contact pressure, and improves the certainty of preventing breakage of the heater 22.

Figure 14:
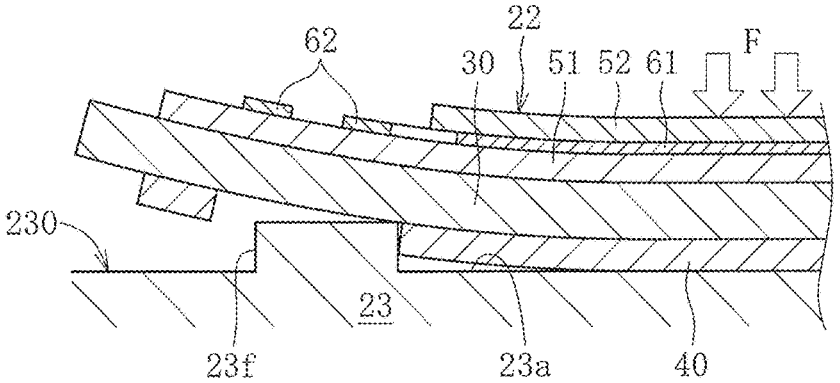
FIG. 14 is a cross-sectional view illustrating an example in which there is no gap between the protrusion and a heat insulation layer.

A height of the protrusion 23*f* (that is, a protrusion amount) is preferably set to be the same as the thickness of the heat insulation layer 40 so that the heater 22 can be reliably supported without bending. However, in practice, it is difficult to completely avoid errors in the thickness of the heater holder 23 and the heat insulation layer 40. If the height of the protrusion 23*f* becomes larger than the thickness of the heat insulation layer 40, the surface on the back side of the heater 22, that is, the heat insulation layer 40 separates from the heater holder 23 as illustrated in FIG. 14. In this case, since application of a pressing force F of the pressure roller to the heater 22 causes a bending of the heater 22, the bending of the heater 22 may break the heat insulation layer 40 made of a brittle material. In addition, although the base layer 30 similarly bends, the bending of the base layer 30 does not cause a problem because the base layer 30 according to the present embodiment is made of ductile material which is hard to be damaged even if bend occurs.

Figure 15:
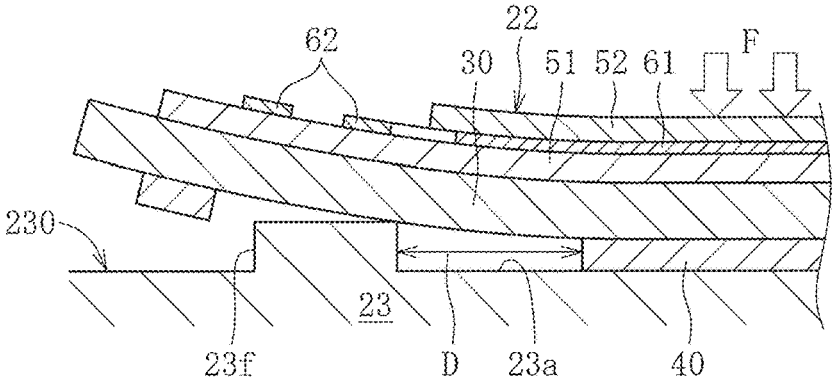
FIG. 15 is a cross-sectional view illustrating an example in which the predetermined gap is provided between the protrusion and the heat insulation layer.

In order to reduce the above-described bending of the heat insulation layer 40, as illustrated in FIG. 15, it is preferable to set a gap D between the protrusion 23*f* and the heat insulation layer 40 in a direction intersecting the thickness direction and in a side in which the pressure roller presses the heater 22, that is, a right side of the protrusion 23*f* in FIG. 15. Since setting the gap D between the protrusion 23*f* and the heat insulation layer 40 described above results in arrangement of the heat insulation layer 40 to a region that does not cause bending, the heat insulation layer 40 does not bend and separate from the heater holder 23, and the heater holder 23 contacts the heat insulation layer 40. This avoids breaking the heat insulation layer 40 due to the bending. On the other hand, in an example illustrated in FIG. 14, since the above-described gap D is not sufficiently disposed, the heat insulation layer 40 separates from the bottom portion 23*a* of the recessed portion 230 in the side in which the pressure roller presses the heater 22, that is, the right side of the protrusion 23*f* in FIG. 14, and the bending of the heat insulation layer 40 increases.

Figure 16:
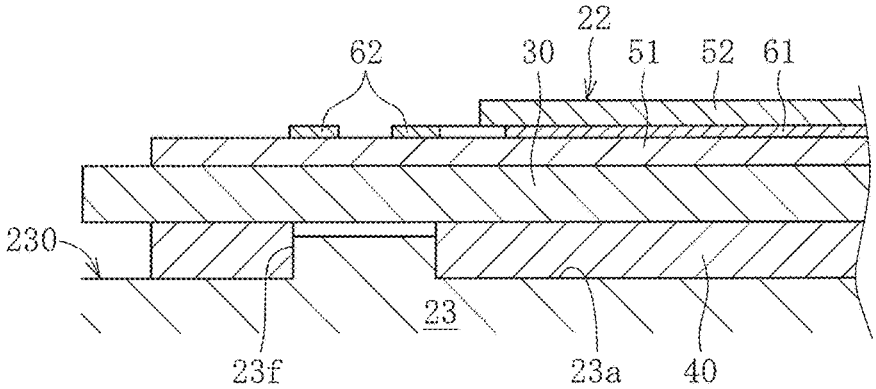
FIG. 16 is a cross-sectional view illustrating an example in which there is no gap between the protrusion and the heat insulation layer.
Figure 17:
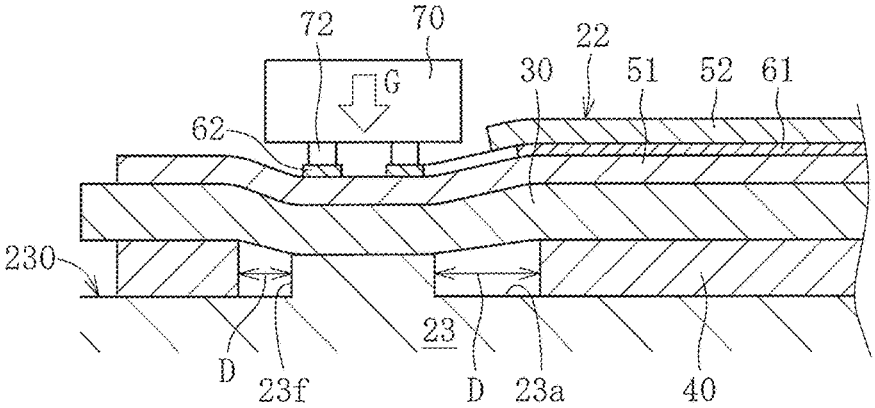
FIG. 17 is a cross-sectional view illustrating an example in which the predetermined gap is provided between the protrusion and the heat insulation layer.

Moreover, contrary to the above-described example illustrated in FIG. 14, as illustrated in FIG. 16, the heat insulation layer 40 may be thicker than the target thickness (that is the same thickness as the height of the protrusion 23*f*) In this case, when the heater 22 is accommodated in the recessed portion 230 of the heater holder 23, as illustrated in FIG. 16, the back-side surface of the heater 22 that is the base layer 30 separates from the protrusion 23*f* of the heater holder 23. However, as illustrated in FIG. 17, when the gap D is disposed between the protrusion 23*f* and the heat insulation layer 40 in the direction intersecting with the thickness direction, and when the connector 70 is connected to the heater 22, a pressing force G of the contact terminal 72 that presses against the electrode 62 bends the heater 22 downward in FIG. 17 and causes the back side surface of the heater 22 to contact the protrusion 23*f*. As described above, even when the heat insulation layer 40 becomes thicker than the target thickness, setting the gap D described above enables the heater 22 to be bent by the pressing force G of the contact terminal 72 and causes the back-side surface of the heater 22 to contact the protrusion 23*f*. This enables the protrusion 23*f* to support the back-side surface of the heater 22 and lead the contact pressure of the contact terminal 72 with respect to the electrode 62 to be stable.

In addition, setting the gap D disposed between the protrusion 23*f* and the heat insulation layer 40 in a direction intersecting the thickness direction as in the example illustrated in FIGS. 15 and 17 avoids interference between the protrusion 23*f* and the heat insulation layer 40 (the edge of the hole 40*a*), which is caused by dimensional tolerances of the heat insulation layer 40 and the protrusion 23*f* (dimensional tolerances in the direction intersecting the thickness direction). Additionally, in the configuration in which the protrusion 23*f* is inserted into the hole 40*a* of the heat insulation layer 40 as in the present embodiment, it is desirable to provide the gap D between the protrusion 23*f* and the heat insulation layer 40 along all-round the hole 40*a*.

The number of protrusions 23*f* is not limited to one and may be more than one. For example, as in the example illustrated in FIG. 18, two protrusions 23*f* may be provided and arranged on portions corresponding to the respective electrode 62. The two protrusions 23*f* separately disposed on the portions corresponding to two electrodes 62, respectively, can reliably support the portions corresponding to electrodes 62, respectively. Preferably, each protrusion 23*f* is disposed corresponding to at least the contact point C in each electrode 62. The above-described configuration can reduce a production cost because the above-described configuration can set tip areas of the protrusions 23*f* that need high dimension accuracy smaller than the configuration in which one protrusion 23*f* supports the portion corresponding to each electrode 62 as illustrated in FIG. 9.

Figure 19:
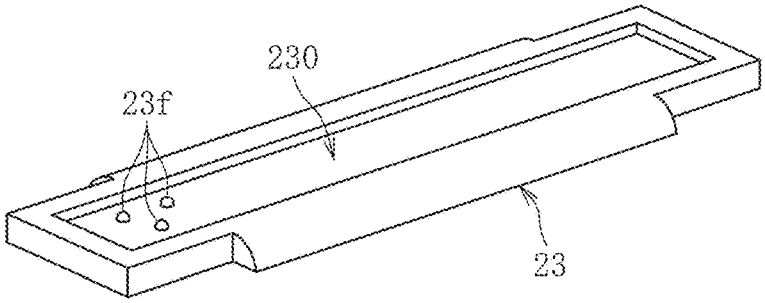
FIG. 19 is a perspective view illustrating an example in which multiple protrusions are disposed at vertexes of a triangle.

As in another example illustrated in FIG. 19, three protrusions 23*f* arranged to form triangle apexes may be provided to support the back-side surface of the base layer 30. This case can further reduce the production cost because the tip area of each protrusion 23*f* can be further reduced (for example, because each protrusion 23*f* can be made spherical, to provide point contact with the base layer 30).

Figure 18:
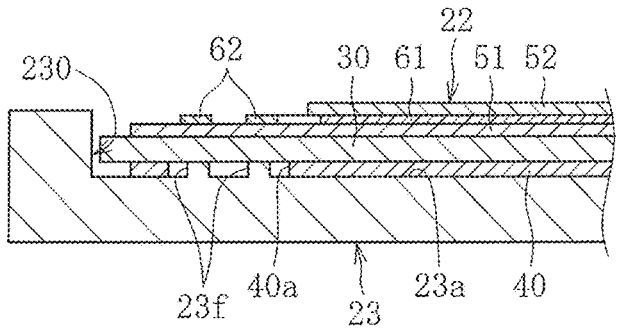
FIG. 18 is a cross-sectional view illustrating an example in which the protrusion is provided at a portion corresponding to the electrodes.
Figure 20:
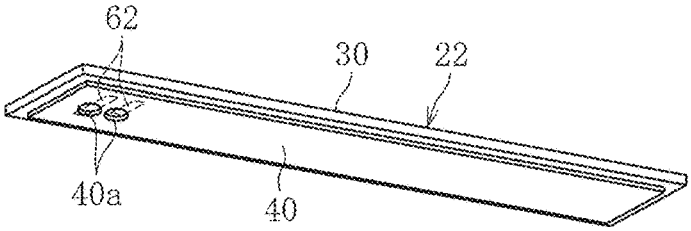
FIG. 20 is a perspective view illustrating an example of the heater having holes formed at portions corresponding to the electrodes.
Figure 21:
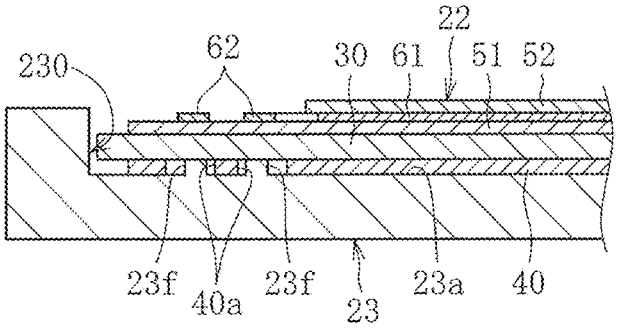
FIG. 21 is a cross-sectional view illustrating an example of the heater illustrated in FIG. 20 held by the heater holder illustrated in FIG. 18.

As in the heater 22 illustrated in FIG. 20, the holes 40*a* in the heat insulation layer 40 may be separately formed in portions corresponding to the respective electrodes 62. As described above, individually forming the holes 40*a* in the portions corresponding to the respective electrode 62 enables the portion in which the heat insulation layer 40 is omitted to be minimized, which suppresses the decrease in rigidity that is caused by omitting the heat insulation layer 40. In this case, as illustrated in FIG. 21, the heater holder 23 illustrated in FIG. 18 is preferably applied as the heater holder 23. As illustrated in FIG. 21, a plurality of protrusions 23*f* disposed on the heater holder 23 is inserted into a plurality of holes 40*a* formed in the heat insulation layer 40, and each of the protrusions 23*f* supports the back-side surface of the base layer 30.

Figure 22:
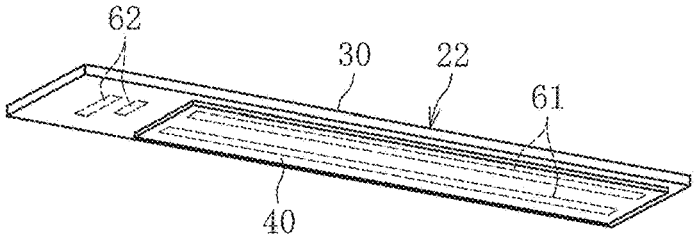
FIG. 22 is a perspective view illustrating an example of the heater including the heat insulation layer disposed corresponding to a heat generator and a vicinity of the heat generator.

As in an example illustrated in FIG. 22, the heat insulation layer 40 may be disposed on a portion corresponding to the heat generator 61 and a vicinity of the heat generator 61. This case enables to reduce a size of the heat insulation layer 40 and the production cost.

Another embodiment of the present disclosure is now described.

In the above-described embodiment (a first embodiment), the heat insulation layer 40 that is one of the layers in the heater 22 is omitted (not provided) in the portion corresponding to the electrodes 62, but in a second embodiment of the present disclosure, a part of the layers in the heater 22 is partially made thin.

Figure 23:
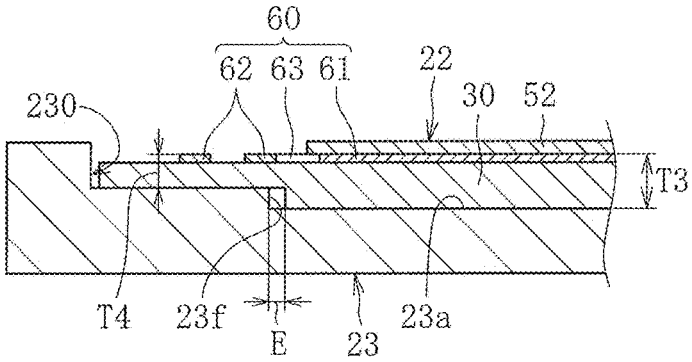
FIG. 23 is a cross-sectional view illustrating the heater according to a second embodiment of the present disclosure.

Specifically, as illustrated in FIG. 23, in the thickness of the base layer 30 that is one of the layers in the heater 22, the portion corresponding to the electrode 62 is thinner than the portion corresponding to the heat generator 61. In other words, the base layer 30 is disposed in the opposite side with respect to the surface on which the electrode is disposed and forms a single portion having a part corresponding to the electrode 62 and a part corresponding to the heat generator 61, and the part corresponding to the electrode 62 is thinner than the part corresponding to the heat generator 61. Reducing the thickness of the base layer 30 in the portion corresponding to the electrode 62 as described above decreases the variation in the thickness of the base layer 30 at the portion. Accordingly, the combined tolerances in the thicknesses of layers of the heater decreases in the portion corresponding to the electrode 62, and the variation in the thickness of the heater 22 also decreases. Since this enables to reduce the variation in the contact pressure from the contact terminals 72 to the electrode 62 and easily manage the contact pressure and prevent the contact pressure from being insufficient or excessive, the contact pressure can be set to the appropriate value (that is, within the appropriate range). In the present embodiment, similar to the first embodiment, the protrusion 23*f* of the heater holder 23 is the contact portion that contacts the base layer 30, but there is the slight gap between the bottom portion 23*a* of the heater holder 23 and the base layer 30, and the bottom portion 23*a* is the portion not in contact with the back surface of the heater 22. Therefore, in the base layer 30 according to the present embodiment, the portion in which the contact portion of the heater holder 23, that is, the protrusion 23*f* contacts the back surface of the heater 22 is thinner than the portion in which the contact portion that is the protrusion 23*f* does not contact the back surface of the heater 22.

Additionally, as illustrated in FIG. 23, in the present embodiment, the protrusion 23*f* that supports the thinly formed portion of the base layer 30 from the back side is disposed in the recessed portion 230 of the heater holder 23.

The current-carrying connector used in the present embodiment has the same configuration as that of the above-described embodiment (the first embodiment) (see FIG. 5). That is, the connector includes the contact terminal 72 that sandwiches the heater 22 and the heater holder 23 together from the front side and the back side and holds the heater 22 and the heater holder 23. When the contact terminal 72 holds the heater 22 and the heater holder 23, the pair of contact portions 72*a* of the contact terminal 72 is pressed against the electrodes 62 of the heater 22. In the above-described configuration in which the contact terminal 72 sandwiches and holds not only the heater 22 but also the heater holder 23, the contact pressure of the contact terminal 72 to the electrode 62 is affected by not only the variation in the thickness of the heater 22 but also the variation in the thickness of the heater holder 23. In this regard, in the present embodiment, as described above, the thickness of the base layer 30 decreases at the portion corresponding to the electrode 62, while the thickness of the heater holder 23 which is provided with the protrusion 23*f* increases. However, in the present embodiment, since the heater holder 23 is a resin molded article molded by a mold, an error in thickness hardly occurs. Therefore, the variation in the thickness of the heater holder 23 caused by the increase in thickness due to the provision of the protrusion 23*f* hardly affects the contact pressure of the contact terminal 72 and does not cause a problem.

A range of the thinly formed base layer 30 is preferably in a range including at least a position corresponding to the contact point C (see FIG. 13) between the contact terminal 72 and the electrode 62. Therefore, the base layer 30 may be recessed and thinned only at the portion corresponding to the contact point C and the vicinity thereof. Additionally, similar to the range of the thinly formed base layer 30, the protrusion 23*f* of the heater holder 23 to support the range is preferably disposed at a position corresponding to at least the contact point C between the contact terminal 72 and the electrode 62. The number of the protrusions 23*f* of the heater holder 23 to support the thinly formed portion of the base layer 30 and a number of the thinly formed portion of the heater holder 23 may be more than one, corresponding to the number of the electrodes 62. As in the example illustrated in FIG. 19, the protrusion 23*f* may be arranged to form a vertex of a triangle.

As illustrated in FIG. 23, in the present embodiment, there is a gap E between the protrusion 23*f* and the base layer 30 in the direction intersecting the thickness direction. Setting the gap E described above enables to avoid interference between the protrusion 23*f* and the base layer 30, which is caused by dimensional tolerances of the base layer 30 and the protrusion 23*f* (dimensional tolerances in the direction intersecting the thickness direction).

Figure 24:
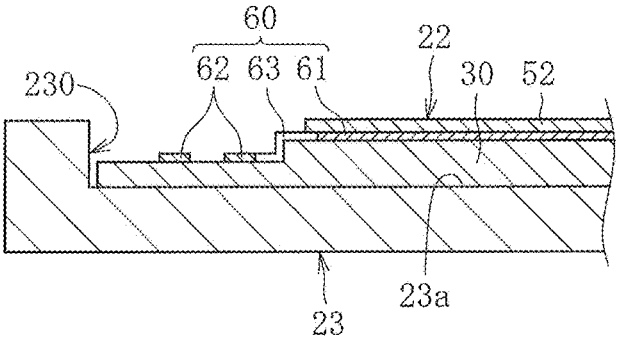
FIG. 24 is a cross-sectional view illustrating an example of the heater in which a front surface of a base layer is changed so that an end portion is thinner than a center portion in a thickness direction.

In the example illustrated in FIG. 23, the back-side portion of the base layer 30 (the lower portion in FIG. 23, or the portion opposite the portion on which the electrode 62 is disposed) is changed in the thickness direction to make the base layer 30 partially formed. Conversely, as in the example illustrated in FIG. 24, the front side portion of the base layer 30 (the upper portion in FIG. 24) may be changed in the thickness direction to make the base layer 30 partially thinner. However, in the example illustrated in FIG. 24, a step is formed in the conductor layer 60 on the front side, and the shape is complicated. Therefore, it is difficult to form the conductor layer 60 by the method of forming the conductor layer 60 by screen printing. Therefore, from the viewpoint of ease of formation of the conductor layer 60, as illustrated in FIG. 23, it is preferable to change the back-side portion of the base layer 30 in the thickness direction.

Figure 25:
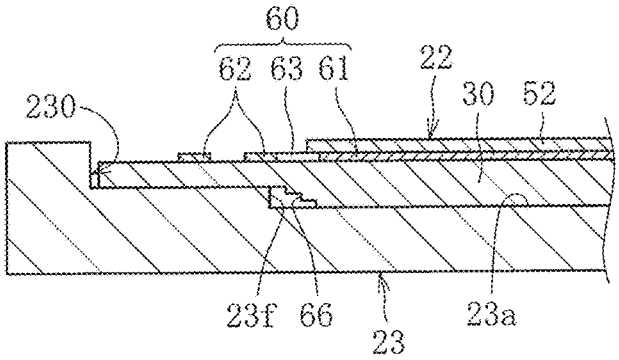
FIG. 25 is a cross-sectional view illustrating an example of the heater including the base layer having a stepped portion including a plurality of steps.
Figure 26:
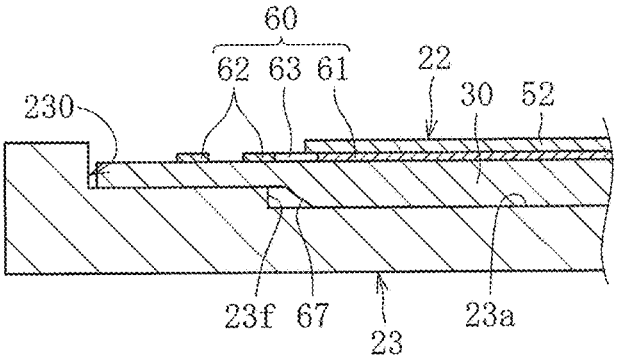
FIG. 26 is a cross-sectional view illustrating an example of the heater including the base layer having a sloping stepped portion.

FIGS. 25 and 26 are cross-sectional views illustrating variations of the second embodiment. In each of the variations illustrated in FIGS. 25 and 26, the shape of the step in which the thickness of the base layer 30 changes is different compared to the example illustrated in FIG. 23 described above.

Specifically, in the example illustrated in FIG. 25, the step of the base layer 30 is a stepped portion 66 that is formed in a stepwise shape having a plurality of steps in the thickness direction which becomes thinner in a step-by-step manner from the portion corresponding to the heat generator 61 to the portion corresponding to the electrode 62. Forming the step of the base layer 30 in the stepwise shape including a plurality of steps enables to make the step (a height) for one step smaller than the step of the base layer 30 that is one step as illustrated in FIG. 23 described above. Therefore, adopting such a configuration enables to form the step (the stepped portion 66) by a method of applying a material paste containing metal powder etc. in a step-like manner while applying masking on the material paste. This method enables to make the base layer 30 in lower cost than a method that forms the large step in the example illustrated in FIG. 23 by cutting.

In the example illustrated in FIG. 26, the step of the base layer 30 is an inclined portion 67 in which the back-side portion of the base layer inclines in the thickness direction to be the base layer 30 gradually thinner from the portion corresponding to the heat generator 61 to the portion corresponding to the electrode 62. In this example, the inclined portion 67 is a flat surface, but may be a curved surface. Compared with the step formed in 90-degree angle illustrated in FIG. 23, the step formed by inclining the base layer 30 can avoid stress concentration such as thermal stress in the step and improve the durability of the base layer 30.

As described above, in the second embodiment of the present disclosure, reducing the thickness of the base layer 30 that is one of the layers in the heater 22 in the portion corresponding to the electrode 62 reduces the variation in the thickness of the heater 22, which results in decrease of variation in contact pressure of the contact terminal. Although the example illustrated in FIGS. 23 to 26 omits the heat insulation layer 40 and the first insulation layer 51 in the first embodiment described above, the examples illustrated in FIGS. 23 to 26 may include the heat insulation layer 40 and the first insulation layer and are not limited by the number of layers in the heater 22 and the type (material) of the layers. Therefore, the layer formed thin in the portion corresponding to the electrode 62 may be one of the layers in the heater 22 which is arbitrarily selected other than the base layer 30. Or, the thicknesses of a plurality of layers arbitrarily selected from the layers in the heater 22 and including the base layer 30 may be reduced. In short, partially reducing the thickness of at least one of the layers in the heater 22 results in a total thickness T4 in the lamination direction from the front side surface of the conductor layer 60 at the region corresponding to the electrode 62 to the back side surface of the heater 22 that is the back side surface of the base layer 30 in the example illustrated in FIG. 23 thinner than a total thickness T3 in the lamination direction from the front side surface of the conductor layer 60 at the region corresponding to the heat generator 61 to the back side surface of the heater 22 that is the back side surface of the base layer 30 in the example illustrated in FIG. 23, in other words, the total thickness in the lamination direction of the portion including the layers in the heater 22 and are layered from the conductor layer 60 toward the base layer 30 is thinner at the region corresponding the electrode 62 (T3) than at the region corresponding to the heat generator 61 (T4).

Figure 27:
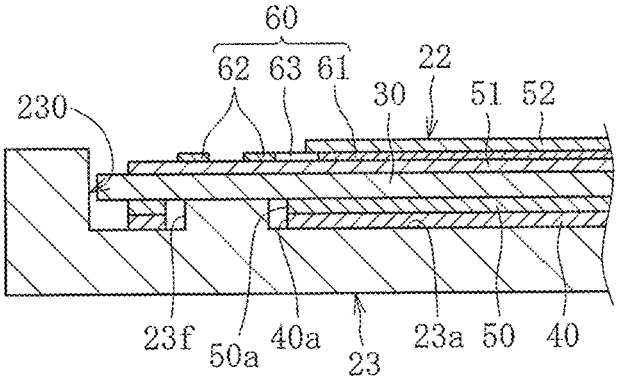
FIG. 27 is a cross-sectional view illustrating the heater and the heater holder according to a third embodiment of the present disclosure.

FIG. 27 is a cross-sectional view illustrating the heater 22 and the heater holder 23 according to a third embodiment of the present disclosure.

As illustrated in FIG. 27, the heater 22 according to the third embodiment includes a high thermal conduction layer 50 between the base layer 30 and the heat insulation layer 40. The high thermal conduction layer 50 is made of a material having a thermal conductivity higher than that of the base layer 30 and the heat insulation layer 40 and has a length substantially equal to the entire heater 22 in the longitudinal direction of the heater 22.

Generally, the fixing device has an issue that temperature on the end side of a heat generation area that is the temperature outside an area for passing the sheet is excessively high when the sheet having a width smaller than the heat generation area of the heater 22 is continuously passed. To decrease such an excessive rise in temperature on the end side, in the present embodiment, the high thermal conduction layer 50 as described above is provided and distributes the heat on the end side that may cause the excessive rise in temperature in the longitudinal direction of the heater 22 that is a sheet width direction. As described above, since the high thermal conduction layer 50 uniformly distributes the heat of the heater 22 in the longitudinal direction, the high thermal conduction layer 50 can prevent the heater 22 from rising the temperature on the end side even when small-size sheets continuously pass. As a result, print productivity of the small-size sheets can be improved because there are no needs to set the sheet passing wait time or to slow the sheet passing speed in order to avoid the temperature rise on the end side.

In this configuration including the high thermal conduction layer 50 according to the present embodiment, as illustrated in FIG. 27, the high thermal conduction layer 50 is omitted at a portion corresponding to the electrode 62 (that is, provided except for the portion corresponding to the electrode 62) to prevent the contact pressure defect (insufficient contact pressure or excessive contact pressure) of the connector 70 with respect to the heater 22. Similarly, the heat insulation layer 40 is also omitted at the portion corresponding to the electrode 62. In other words, the heat insulation layer 40 and the high thermal conduction layer 50 are disposed in the opposite side with respect to the surface on which the electrode is disposed, and the heat insulation layer 40 and the high thermal conduction layer 50 have holes corresponding to the electrode 62. Each hole forms a plurality of portions in each of the heat insulation layer 40 and the high thermal conduction layer 50, and the gap formed bay the hole exists between the plurality of portions.

As described above, in the present embodiment, partially omitting the heat insulation layer 40 and the high thermal conduction layer 50 at the portion corresponding to the electrode 62 reduces the combined tolerances of the layers in the heater 22 and the variation in the contact pressure of the contact terminal 72 with respect to the electrode 62. To obtain the above-described advantage, the high thermal conduction layer 50 and the heat insulation layer 40 are removed at least the portion corresponding to the contact point C between the contact terminal 72 and the electrode 62 (see FIG. 13) in the portion corresponding to the electrode 62 and arranged. The current-carrying connector used in the present embodiment has the same configuration as that of the above-described embodiment (the first embodiment) (see FIG. 5).

As illustrated in FIG. 27. In the present embodiment, the high thermal conduction layer 50 and the heat insulation layer 40 have holes 50*a* and 40*a* in portions corresponding to the electrode 62. Through the holes 50*a* and 40*a*, the protrusion 23*f* disposed on the heater holder 23 supports the back-side surface of the base layer 30. The configuration of the heater holder 23 according to the present embodiment may be the above-described configuration having two protrusions 23*f* as illustrated in FIG. 18 or the above-described configuration having three protrusions 23*f* as illustrated in FIG. 19.

Similar to the heat insulation layer 40 illustrated in FIG. 20 described above, the hole 50*a* of the high thermal conduction layer 50 may be separately disposed on the portion corresponding to the electrodes 62. In this case, minimizing the portion on which the high thermal conduction layer 50 is omitted enables providing the high thermal conduction layer 50 on a wide area. Or, conversely, the portion on which the high thermal conduction layer 50 is provided may be a requisite minimum. Since the high thermal conduction layer 50 may be provided at least in the area on which the temperature rise on the end side may occur, for example, similar to the above-described heat insulation layer 40 illustrated in FIG. 22 described above, the high thermal conduction layer 50 may be disposed on a region corresponding to the heat generator 61 and a vicinity of the heat generator 61. In this case, minimizing the portion on which the high thermal conduction layer 50 is provided reduces cost. In addition, since minimizing the portion on which the high thermal conduction layer 50 is provided can prevent the heat from transmitting to the electrode 62 via the high thermal conduction layer 50, an inexpensive material with low heat resistance may be used as the material of the electrode 62.

Figure 28:
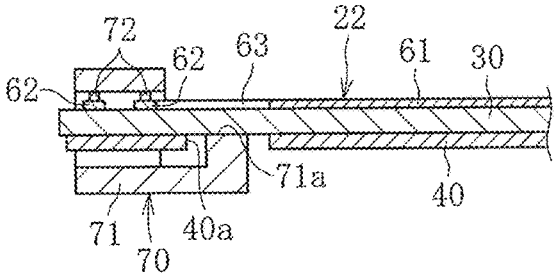
FIG. 28 is a cross-sectional view illustrating the heater and the connector according to a fourth embodiment of the present disclosure.

FIG. 28 is a cross-sectional view illustrating the heater 22 and the connector 70 according to a fourth embodiment of the present disclosure;

As illustrated in FIG. 28, in the fourth embodiment, the connector 70 directly contacts with the back side of the heater 22. In the above embodiment, the heater holder 23 is a contact member that directly contacts the back side of the heater 22. However, in the present embodiment, the connector 70 is the contact member that directly contacts the back side of the heater 22. In the example illustrated in FIG.

28, the housing 71 of the connector 70 is extended in the longitudinal direction of the heater 22 that is a right direction in FIG. 28 and bent in the thickness direction of the heater 22 that is an upper direction in FIG. 28, and a tip 71*a* of a bent portion in which the housing 71 of the connector 70 is bent contacts the back side of the base layer 30. That is, in this case, the tip 71*a* of the bent portion of the housing 71 is the contact portion that contacts the back side of the heater 22. The heat insulation layer 40 is removed a portion corresponding to a portion on which the tip 71*a* contacts the back side of the heater 22, and the hole 40*a* is provided. In other words, the heat insulation layer 40 is disposed in the opposite side with respect to the surface on which the electrode is disposed and has a hole corresponding to the contact portion. The hole forms a plurality of portions in the heat insulation layer 40, and the gap formed by the holes exists between the plurality of portions. This can reduce the variation in the contact pressure of the contact terminal 72 because the contact pressure of the contact terminal 72 against the electrode 62 becomes less susceptible to the variation in the contact pressure of the contact terminal 72 compared with a configuration in which the heat insulation layer 40 does not have the hole 40*a* on the portion on which the tip 71*a* contacts the back side of the heater 22. A configuration of the present embodiment is different from the configuration of the above-described embodiment and has the hole 40*a* that is the portion removed the heat insulation layer 40, the hole 40*a* shifted from the position corresponding to the electrode 62 in the longitudinal direction of the heater 22. However, this configuration can also reduce the variation in the contact pressure of the contact terminal 72. The configuration including the portion removed the heat insulation layer 40 and shifted from the position corresponding to the electrode 62 is considered that the degree of freedom in design is enhanced because this configuration can reduce the variation in the contact pressure even when providing a part that contacts the heater on the portion corresponding to the electrode 62 is difficult, for example, when another component is disposed on the portion corresponding to the electrode 62. The configuration illustrated in FIG. 23 may be applied to the configuration illustrated in FIG. 28, that is, the thickness of layer on the portion on which the tip 71*a* that is the contact portion of the connector 70 contacts the back side of the heater 22 may be thinner than the thickness of layer on the other portion.

The above-described embodiments are illustrative and do not limit this disclosure. It is therefore to be understood that within the scope of the appended claims, numerous additional modifications and variations are possible to this disclosure otherwise than as specifically described herein. Therefore, the above-described embodiments and their variations may be combined as appropriate. The above-described embodiment is configured by either removing a part of at least one of the layers in the heater or reducing a thickness of the part of at least one of the layers in the heater, but the heater may be configured by removing a part of at least one of the layers in the heater and reducing a thickness of the part of another one of the layers in the heater. The plurality of layers in the heater 22 may be the base layer and layers having different thermal conductivity from the base layer. The first insulation layer may be provided on the opposite side of the layer having different thermal conductivity from the base layer, or the second insulation layer may be provided on the surface on which the electrode and the heat generator connected to the electrode are disposed. The layer having different thermal conductivity from the base layer may have higher thermal conductivity than the base layer or lower thermal conductivity than the base layer.

In the above-described embodiment, although the rectangular hole 40*a* is formed in a part of the heat insulation layer 40 by removing the part of the heat insulation layer 40, the layer removed the part of itself as described above is not limited to the low thermal conduction layer having lower thermal conductivity than the base layer 30, such as the heat insulation layer 40 described above. As such the layer, for example, contrary to the heat insulation layer 40, a heat-equalization layer (thermally conductive metal layer) may be used that is made of a material having a thermal conductivity higher than that of the base layer 30, such as copper, aluminum, silver, bronze. That is, the layer removed a part of itself may be the layer having higher thermal conductivity than the base layer 30 (that is, the heat-equalization layer or the thermally conductive metal layer), or the layer having lower thermal conductivity than the base layer 30 (that is, the heat insulation layer or the low thermal conduction layer). That is, the layer removed a part of itself may be the layer having different thermal conductivity from the base layer 30.

Figure 29:
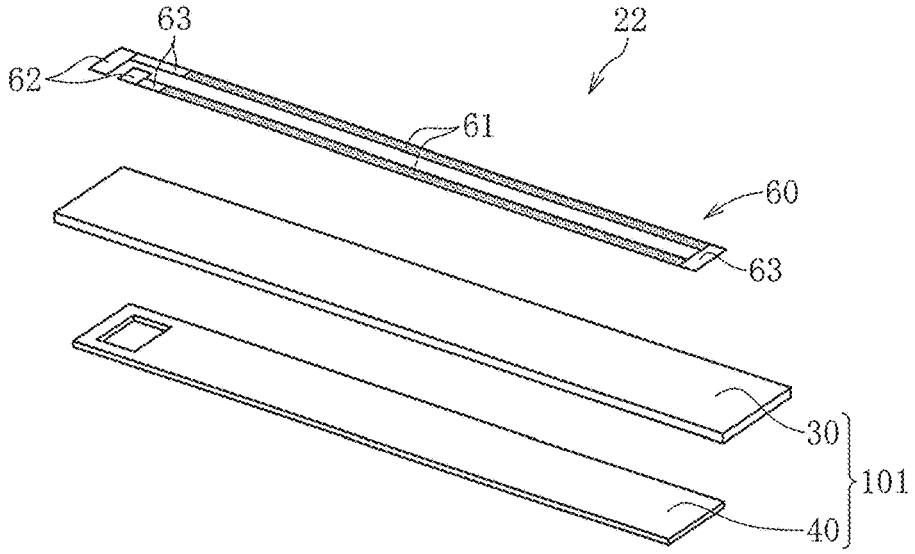
FIG. 29 is an exploded perspective view illustrating an example of another heater.

As in the example illustrated in FIG. 29, the first insulation layer 51 and the second insulation layer 52 may be removed, and the heater 22 may be configured by the heat insulation layer 40, the base layer 30, and the conductor layer 60. As in the example illustrated in FIG. 30, the heater 22 may have a configuration including a lowest layer 41 on the back side of the heat insulation layer 40 in addition to the heat insulation layer 40, the base layer 30, the first insulation layer 51, the conductor layer 60, and the second insulation layer 52. In each of the examples illustrated in FIGS. 29 and 30, the heat insulation layer 40 is removed the portion corresponding to the electrode 62.

Figure 30:
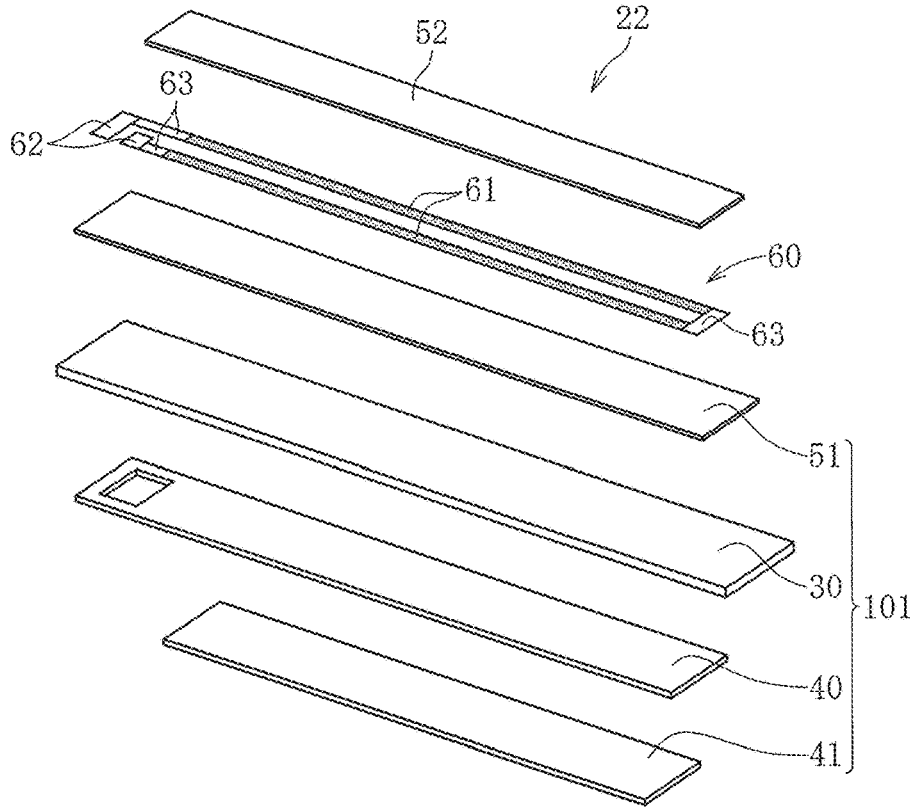
FIG. 30 is an exploded perspective view illustrating an example of still another heater.

In short, in the heater according to the present disclosure, the plate 101 provided with the electrode 62 and the heat generator 61 may be configured by the heat insulation layer 40, the base layer 30, and the first insulation layer 51 as illustrated in FIG. 4, or by the heat insulation layer 40 and the base layer 30 as illustrated in FIG. 29. Or, the plate 101 may be configured by the lowest layer 41, the heat insulation layer 40, the base layer 30, and the first insulation layer 51 as illustrated in FIG. 30. In addition, the layer removed the part of itself or thinly formed the part of itself, which is at least one layer of the plurality of layers included in the plate 101 described above, may be an outermost layer to the surface on which the electrode 62 is disposed (see FIGS. 4 and 29), or a layer between the surface on which the electrode 62 is disposed and the outermost layer (see FIG. 30). That is, a position of the layer removed the part of itself or thinly formed the part of itself does not matter. For example, in the example illustrated in FIG. 30, the layer removed the part of itself may be the lowest layer 41 or the base layer 30 in addition to the heat insulation layer 40.

Figure 31:
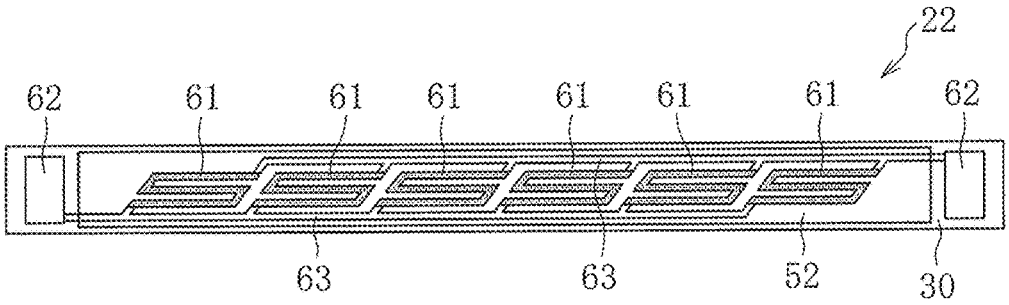
FIG. 31 is an exploded perspective view illustrating an example of yet a further different heater.

In the above-described embodiment, the heater 22 has the two heat generators 61 are disposed parallel to each other in the longitudinal direction of the base layer 30 and electrically connected in series, but, as in the example illustrated in FIG. 31, the heater 22 may have a plurality of heat generators 61 arranged at intervals in the longitudinal direction of the base layer 30 (that is also a belt width direction). As in this example, each heat generator 61 may be formed in a shape having a plurality of folded portions and electrically connected in parallel to a pair of electrodes 62 disposed at both ends in the longitudinal direction of the base layer 30. In the heater 22 having the plurality of heat generators 61, the gap between the heat generators 61 adjacent to each other is preferably 0.2 mm or more, more preferably 0.4 mm or more from the viewpoint of maintaining the insulation between the heat generators 61. In addition, the gap between the heat generators 61 adjacent to each other is preferably 5 mm or less, more preferably 1 mm or less from the viewpoint of reducing temperature unevenness along the longitudinal direction because too large gap between the heat generators 61 adjacent to each other easily causes a temperature drop in the gap.

Moreover, in the above-described embodiment, although electrode 62 of heater 22 is connected to the heat generator 61, the present disclosure is not limited to this. For example, the present disclosure is also applicable to a configuration in which the electrode is connected to a temperature sensor such as a thermistor.

Figure 32:
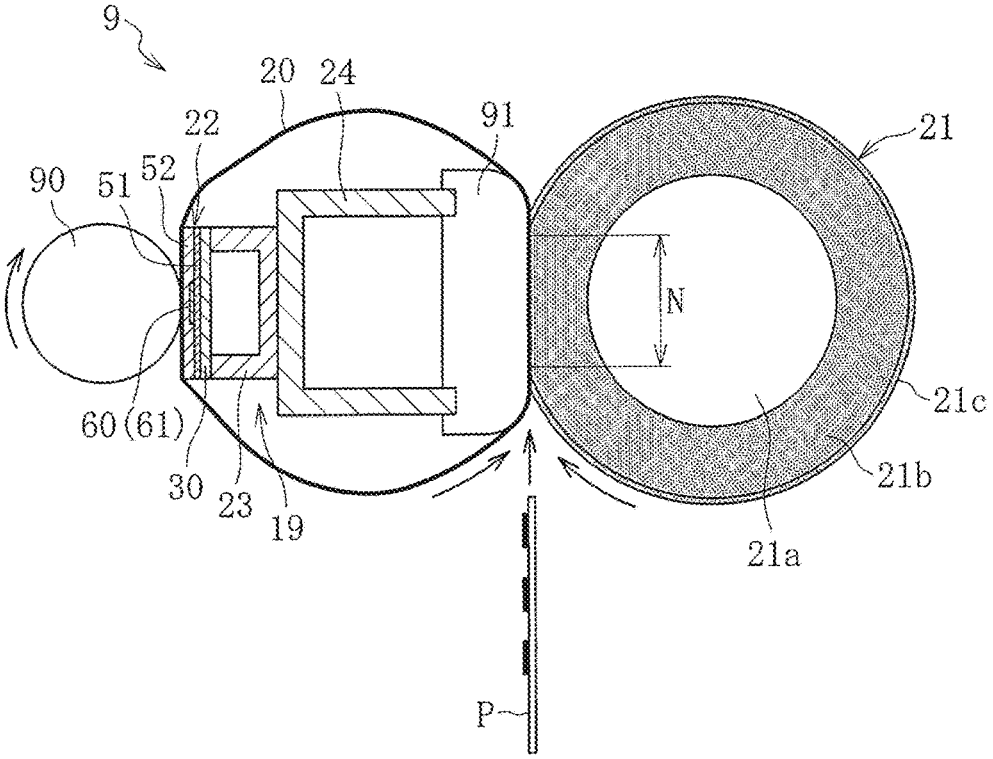
FIG. 32 is a schematic diagram illustrating a configuration of another fixing device.
Figure 33:
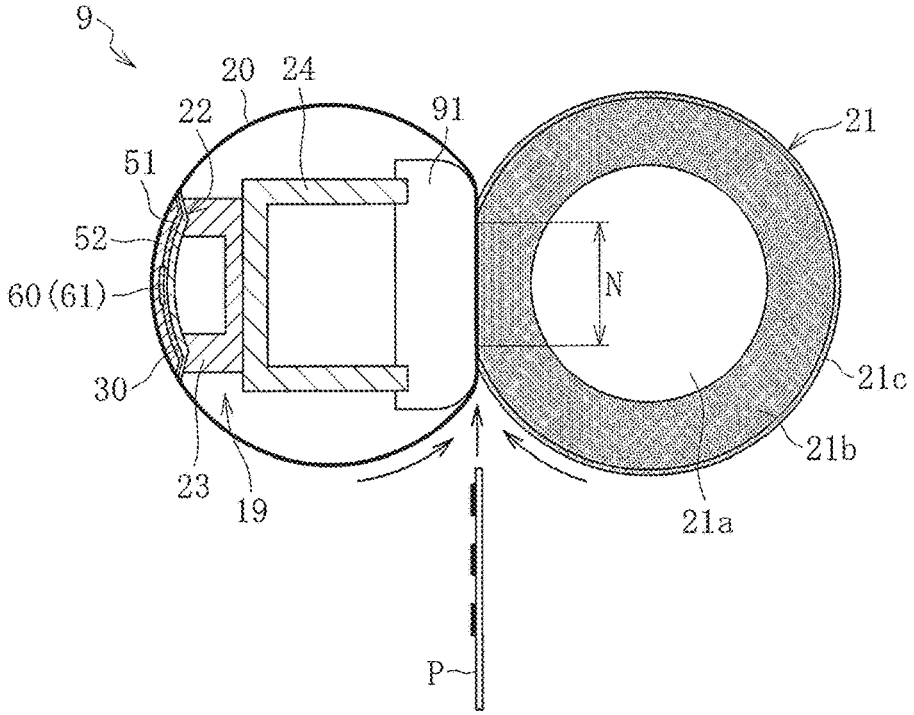
FIG. 33 is a schematic diagram illustrating a configuration of still another fixing device.
Figure 34:
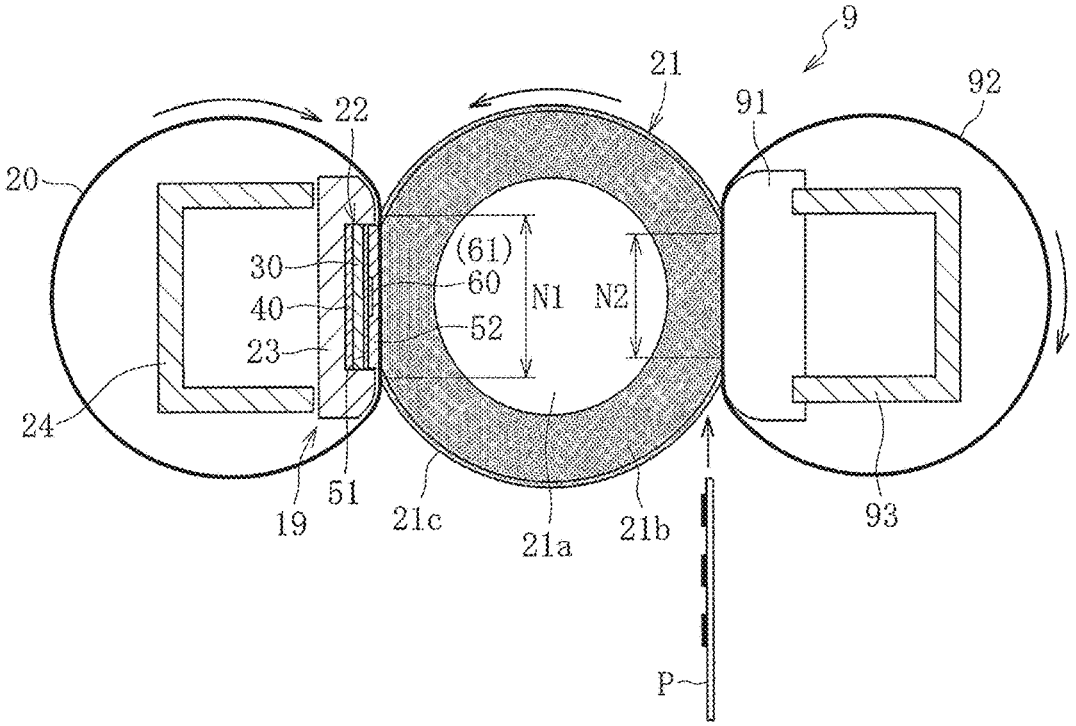
FIG. 34 is a schematic diagram illustrating a configuration of yet a further different fixing device.

The present disclosure is also applicable, for example, to fixing devices as illustrated in FIGS. 32 to 34, in addition to the fixing device illustrated in FIG. 2. The configuration of each fixing devices illustrated in FIGS. 32 to 34 is briefly described below.

First, the fixing device 9 illustrated in FIG. 32 includes a pressurization roller 90 opposite the pressure roller 21 with respect to the fixing belt 20 and heats the fixing belt 20 sandwiched by the pressurization roller 90 and the heater 22. On the other hand, in the side of the pressure roller 21, a nip formation pad 91 is disposed inside the inner circumferential surface of the fixing belt 20. The stay 24 supports the nip formation pad 91, and the nip formation pad 91 and the pressure roller 21 sandwiches the fixing belt 20 to form the nip N.

Next, the fixing device 9 illustrated in FIG. 33 is omitted the above described pressurization roller 90 and includes the heater 22 configured by an arc-shaped plate having a curvature of the fixing belt 20 to keep a circumferential contact length between the fixing belt 20 and the heater 22. The fixing device 9 illustrated in FIG. 33 is identical to the fixing device 9 illustrated in FIG. 32 in terms of the others.

Lastly, the fixing device 9 illustrated in FIG. 34 includes a pressing belt 92 in addition to the fixing belt 20 and has a heating nip (a first nip) N1 and the fixing nip (a second nip) N2 separately. That is, the nip formation pad 91 and the stay 93 are disposed opposite the fixing belt 20 with respect to the pressure roller 21, and the pressing belt 92 is rotatably arranged to wrap around the nip formation pad 91 and the stay 93. The sheet P passes through the fixing nip N2 between the pressing belt 92 and the pressure roller 21 and is applied to heat and pressure, and the image is fixed on the sheet P. The fixing device 9 illustrated in FIG. 34 is identical to the fixing device 9 illustrated in FIG. 2 in terms of the others.

As described above, in the fixing device according to the present disclosure, the portion corresponding to at least one part of the electrode (that is, the contact point C) in the layer is removed or made thinner. Or, the portion in the one layer is removed, and the portion in the other layer is made thinner. These can reduce the variation in thickness of the heater and prevent contact pressure failure of the connector with respect to the heater. Without adopting the configuration in which the contact terminal is movable relative to the housing, adopting the configuration of the present disclosure enables to ensure the electrical connection between the connector and the heater, simplify the configuration of the connector, and prevent the heating device from increasing the cost and the size.

In the configuration as illustrated in FIG. 6, in which the connector 70 elastically contacts only one side of the heater 22 in the thickness direction (only the upper surface side of the heater 22 in FIG. 6), the large variation in the thickness of the heater tends to cause the larger variation in the contact pressure of the connector with respect to the heater than in the configuration in which the connector elastically contacts both sides of the heater in the thickness direction. However, even in the configuration in which the connector 70 elastically contacts only one side of the heater 22 in the thickness direction, applying the present disclosure can stabilizes the contact pressure of the connector with respect to the heater. That is, without adopting a connector which elastically contacts the heater from both sides in the thickness direction, the present disclosure can simplify the configuration and reduce the cost because the contact pressure defects of the connector with respect to the heater can be effectively prevented.

In addition to the above-described fixing device, the heater and the heating device according to the present disclosure is also applicable to a dryer to dry ink applied to the sheet and a coating device (a laminator) that heats, under pressure, a film as a covering member onto the surface of the sheet such as paper. The image forming apparatus 100 according to the embodiments of the present disclosure may be a copier, a facsimile machine, a multifunction peripheral (MFP) having at least two of copying, printing, scanning, facsimile, and plotter functions in addition to the printer. Embodiments of the present disclosure may be applied to an ink jet type image forming apparatus in addition to the electrophotographic type image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A heater configured to contact a contact portion of a contact member, the heater comprising:
- an electrode;
- a heat generator; and
- a plurality of layers including,
  - a first layer, and
  - at least one layer disposed in an opposite side with respect to a surface on which the electrode is disposed, the at least one layer including at least one of:
    - a plurality of portions with a gap therebetween at a position at which the contact portion of the contact member contacts the heater, and
    - a single portion, a thickness of at least a part of the single portion at the position at which the contact portion of the contact member contacts the heater, being relatively thinner than a thickness of at least a part of the single portion at which the contact portion does not contact the heater.

2. The heater according to claim 1, wherein, in a lamination direction of the plurality of layers, a total thickness of the electrode and the plurality of layers, at a position corresponding to the electrode, is relatively thinner than a total thickness of the heat generator and the plurality of layers, at a position corresponding to the heat generator.

3. The heater according to claim 2, wherein a difference, between the total thickness of the electrode and the plurality of layers at the position corresponding to the electrode and the total thickness of the heat generator and the plurality of layers at the position corresponding to the heat generator, is 50 μm or more.

4. The heater according to claim 1, wherein the plurality of layers includes, a base layer in addition to or as the first layer, and a layer in addition to or as the at least one layer and having a thermal conductivity different from the base layer; and wherein the layer having the thermal conductivity different from the base layer is disposed corresponding to at least one part of the heat generator excluding a portion of the layer corresponding to the electrode.

5. The heater according to claim 1, wherein the plurality of layers includes, in addition to or as the first layer and at least one layer respectively, a base layer, a layer having a thermal conductivity different from the base layer, and a relatively high thermal conduction layer having a thermal conductivity relatively higher than the base layer and disposed between the base layer and the layer having a thermal conductivity different from the base layer, and wherein the relatively high thermal conduction layer is disposed corresponding to at least one part of the heat generator, except for at least one portion of the relatively high thermal conduction layer corresponding to the electrode.

6. The heater according to claim 1, wherein the plurality of layers includes a base layer, and a thickness of the base layer, at a position corresponding to the electrode, is relatively thinner than a thickness of the base layer at a position corresponding to the heat generator.

7. A heating device comprising:

the heater according to claim 1; and the contact member including the contact portion to contact any one of a part at the position corresponding to the electrode and the part of the single portion corresponding to the electrode.

8. The heating device according to claim 7, wherein the contact portion is a protrusion, and a gap exists between the protrusion and the at least one layer.

9. A fixing device comprising:

the heating device according to claim 8;

a fixing rotator, configured to be heated by the heating device to fix an image on a recording medium; and an opposed rotator to contact the fixing rotator to form a nip.

10. An image forming apparatus comprising:

the heater according to claim 1.

11. The heater according to claim 1, wherein the electrode is configured to connect to the contact member only via an upper surface of the electrode such that the contact member does not contact a lower surface of the electrode.

12. The heater according to claim 1, wherein the electrode and the heat generator are at the first layer of the plurality of layers and the at least one layer is below the first layer.

13. The heater according to claim 12, wherein the heater is configured to contact the contact portion of the contact member to receive power therefrom.

14. The heater according to claim 1, wherein the contact member includes at least one of a holder and a connector.

15. A heater configured to contact a contact portion of a contact member, the heater comprising:

an electrode;

a heat generator; and a plurality of layers including a first layer and a second layer, the second layer disposed in an opposite side with respect to a surface on which the electrode is disposed, the second layer including at least one of, (i) a plurality of portions separated from one another at a position at which the contact portion of the contact member contacts the heater with the plurality of portions not contacting the contact portion of the contact member, and (ii) a single portion, a thickness of a first part of the single portion at the position at which the contact portion of the contact member contacts the heater, being relatively thinner than a thickness of a second part of the single portion at which the contact portion does not contact the heater.

16. The heater according to claim 15, wherein, in a lamination direction of the plurality of layers, a total thickness of the electrode and the plurality of layers at a position corresponding to the electrode is relatively thinner than a total thickness of the heat generator and the plurality of layers at a position corresponding to the heat generator.

17. The heater according to claim 16, wherein a difference, between the total thickness of the electrode and the plurality of layers at the position corresponding to the electrode and the total thickness of the heat generator and the plurality of layers at the position corresponding to the heat generator, is 50 μm or more.

18. The heater according to claim 15, wherein the plurality of layers includes, a base layer in addition to or as the first layer, and a layer in addition to or as the second layer and having a thermal conductivity different from the base layer; and wherein the layer having the thermal conductivity different from the base layer is disposed corresponding to at least one part of the heat generator excluding a portion of the layer corresponding to the electrode.

19. The heater according to claim 15, wherein the plurality of layers includes, in addition to or as the first layer and the second layer respectively, a base layer, a layer having a thermal conductivity different from the base layer, and a relatively high thermal conduction layer having a thermal conductivity relatively higher than the base layer and disposed between the base layer and the layer having a thermal conductivity different from the base layer, and wherein the relatively high thermal conduction layer is disposed corresponding to at least one part of the heat generator, except for at least one portion of the relatively high thermal conduction layer corresponding to the electrode.

20. The heater according to claim 15, wherein the plurality of layers includes a base layer, and a thickness of the base layer at a position corresponding to the electrode is relatively thinner than a thickness of the base layer at a position corresponding to the heat generator.

21. A heating device comprising:

the heater according to claim 15; and the contact member including the contact portion to contact any one of a part at the position corresponding to the electrode and the part of the single portion corresponding to the electrode.

22. The heating device according to claim 21, wherein the contact portion is a protrusion, and a gap exists between the protrusion and the second layer.

23. A fixing device comprising:

the heating device according to claim 22;

a fixing rotator configured to be heated by the heating device to fix an image on a recording medium; and an opposed rotator to contact the fixing rotator to form a nip.

24. An image forming apparatus comprising:

the heater according to claim 15.

25. The heater according to claim 15, wherein the electrode is configured to connect to the contact member only via an upper surface of the electrode such that the contact member does not contact a lower surface of the electrode.

26. The heater according to claim 15, wherein the electrode and the heat generator are at the first layer of the plurality of layers and the second layer is below the first layer.

27. The heater according to claim 26, wherein the heater is configured to contact the contact portion of the contact member to receive power therefrom.

28. The heater according to claim 23, wherein the contact member includes at least one of a holder and a connector.

* * * * *